US006953222B2

(12) United States Patent
Larrick et al.

(10) Patent No.: US 6,953,222 B2
(45) Date of Patent: Oct. 11, 2005

(54) PORTABLE UTILITY STAND

(76) Inventors: George Edward Larrick, 78202 Kensington Ave., Palm Desert, CA (US) 92211; Mary Teresa Larrick, 1508 Chelsea Rd., Palos Verdes Estates, CA (US) 90274; Daniel Edward Larrick, P.O. Box 3911, Costa Mesa, CA (US) 92628

( * ) Notice: Subject to any disclaimer, the term of this patent is extended or adjusted under 35 U.S.C. 154(b) by 60 days.

(21) Appl. No.: 10/633,549

(22) Filed: Aug. 5, 2003

(65) Prior Publication Data

US 2005/0029841 A1 Feb. 10, 2005

(51) Int. Cl.[7] ..... A47B 39/00

(52) U.S. Cl. ..... 297/172; 297/174 R; 297/118; 297/129

(58) Field of Search ..... 297/172, 174 R, 297/118, 129; 248/460, 461, 441.1

(56) References Cited

U.S. PATENT DOCUMENTS 5,054,852 A * 10/1991 Tholkes ..... 297/172
5,350,215 A * 9/1994 DeMars ..... 297/188.14
5,765,910 A * 6/1998 Larkin et al. ..... 297/172
5,882,070 A * 3/1999 Genn ..... 297/174 R
5,882,083 A * 3/1999 Robinson ..... 297/440.2
6,012,696 A * 1/2000 Borie ..... 248/461
6,068,355 A * 5/2000 Thorp ..... 312/241
6,264,161 B1 * 7/2001 Waggoner ..... 248/460
6,293,511 B1 * 9/2001 Shepherd ..... 248/441.1
6,439,657 B1 * 8/2002 Tholkes ..... 297/172
6,663,074 B2 * 12/2003 Prior ..... 248/461

* cited by examiner

*Primary Examiner*—Peter M. Cuomo
*Assistant Examiner*—Erika Garrett

(57) ABSTRACT

A portable utility stand that integrates the equipment required by users such as musicians, artists, and surveyors. These users generally require a lighted work platform, a tool or instrument support, a comfortable adjustable seat, a storage area for equipment such as tools, an adjustable footrest, shelf to temporarily place equipment, a means to support equipment such as, microphones, tuning devices or a telephone. The equipment is mounted to a base platform equipped with mounting receptacles that allow the user to arrange, adjust, and select suitable equipment for a particular application and in a preferred arrangement. The base platform is essentially a single member with receptacles for equipment mounting. A seating bench with storage unit is centrally located with respect to the mounting receptacles. Floor glides are mounted on bottom extreme ends. Disassembly simply requires removing the receptacle mounted equipment.

12 Claims, 28 Drawing Sheets

20
22
20
111
100
99
101
109
108
110
105
97
98

PORTABLE UTILITY STAND

BACKGROUND OF THE INVENTION

The present invention relates to a utility stand. More particularly to a utility stand for users requiring a portable work/utility stand. The utility stand incorporates the basic equipment a musician, surveyor, artist, or any user that requires a complete platform for work, practice or performing into a single structure that is easily disassembled or collapsed for storage and transport between uses.

Prior art includes examples of a Portable Workstation, U.S. Pat. No. 6,068,355, a Portable Music Stand, U.S. Pat. No. 6,264,161. Other Portable equipment used by musicians, surveyors, and artists among others include portable footrests, portable instrument support stands, and portable reference tables and portable microphone stands.

While having some utility these separate components have several major drawbacks. First, as individual pieces of equipment they lack stability and are easily knocked over because of their small support bases. Because they are separate pieces they are cumbersome to transport and setup. Also, the separate pieces of equipment require a larger total floor area than a single integrated utility stand. This is because the separate pieces of equipment require an extended base around each piece of equipment to achieve stability. Moreover, these separate pieces of equipment duplicate functions of the individual pieces and therefore more parts are fabricated than necessary.

Another problem with portable work stations and music stands is the lack of convenient storage for tools, reference material, sheet music, and accessories, e.g. tools, paint brushes, pencils, guitar strings, markers, tuning devices to name a few which a user may require for work, study, or practice.

Another problem is the lack of comfortable seating that can be adjusted to the user needs and workstation level.

Accordingly, it is an object or the present invention to provide a portable utility stand that combines the separate components into a single utility stand configured for specific or multiple applications. This invention is focused toward the musician, but can be tailored for aforementioned users.

Another object is to minimize the number of components and complexity by combining functions of support, seating, and storage.

Yet another object is to provide an improved process for collapsing and setting up the portable utility stand for transport or storage requiring fewer set up steps. Yet another object of this invention is to configure mating parts such that the assembly cannot be setup in a manner that makes it unsafe for use.

Yet another object of this invention is to provide a compact portable stand that is more resistant to tipping over when jostled or bumped than the individual pieces of equipment it replaces Yet another object of this invention is to provide convenient storage for the users reference material and accessories.

Yet another object of this invention is to minimize the required floor area.

Yet another object of this invention to provide for additional auxiliary equipment to be attached such as a microphone, instrument tuning device, artists easel, or an umbrella to name but a few.

BRIEF SUMMARY OF THE INVENTION

To achieve these and other objects, there is provided a portable utility stand with a substantially horizontal base frame supporting universal mounting receptacles that accept a broad range of components thereby enabling the base frame to integrate components such as: 1. a seating/storage unit, 2. a sheet music support or work platform, 3. a microphone/ancillary equipment support, 3. a foot rest, 4. an instrument or tool rest and a reference table to name but a few into a single unit. This single unit requires less floor area than the total floor area required by the same separate components; but has a larger stabilizing floor footprint than each separate component. This larger footprint provides more resistance to being tipped over than the separate units provide and achieves this with fewer parts.

The base with universal mounting receptacles allows right hand or left-hand users to set up the components, as they prefer. In addition, a user could use the same utility stand for multiple uses by using for example the artist's easel in place of the sheet music support platform.

At one end of the base frame a vertically adjustable member supports a padded seating bench with backrest. The bench provides both seating and storage. The storage unit is substantially below the seat with shelves and drawers that allow easy access without getting up from the seating bench.

At the other end of the base frame is a rotatable and telescoping post supporting a rotatable platform. The platform thus mounted is adjustable by the user to provide a comfortable viewing distance and angle.

Also attached to the base frame and in close proximity to the seat is an adjustable foot support that can be raised or lowered vertically, shifted left or right horizontally, tilted up or down, and support either foot or both feet simultaneously.

Also attached to the base frame is an instrument support. The instrument support is rotatable about the vertical support axis and the user may install it any of the universal mounts on the left, right or behind.

Also, attached to the frame is a rotatable horizontal/table platform close to hand for easy access and storage of the user's accessories. As with all the components configured for this utility stand they can be mounted in any receptacle In a preferred embodiment the utility stand is comprised of a tubular structure which is collapsible to a configuration suitable for transport or storage.

In conjunction with the portable stand, another aspect of the present invention is a process for stowing the stand, including:

a. a means for disconnecting/collapsing the seating bench storage unit.

b. a means for rotating the sheet music platform support to be substantially parallel with the base.

c. a means for disconnecting/collapsing the instrument support.

d. a means for removing/collapsing the accessory shelf.

e. a means for disconnecting/collapsing the auxiliary equipment supports.

Thus in accordance with the present invention, a stable portable utility stand that supports user requirements for comfortable seating, displaying sheet music or other work in progress, storing accessories and reference material, supporting auxiliary equipment such as a microphone and providing a reference table is easily collapsed and setup.

BRIEF DESCRIPTION OF THE DRAWINGS

For a further appreciation of the above and other features and advantages, reference is made to the following detailed description of this invention and to the drawings, in which.

DETAILED DESCRIPTION OF THE INVENTION

Figure 1A:
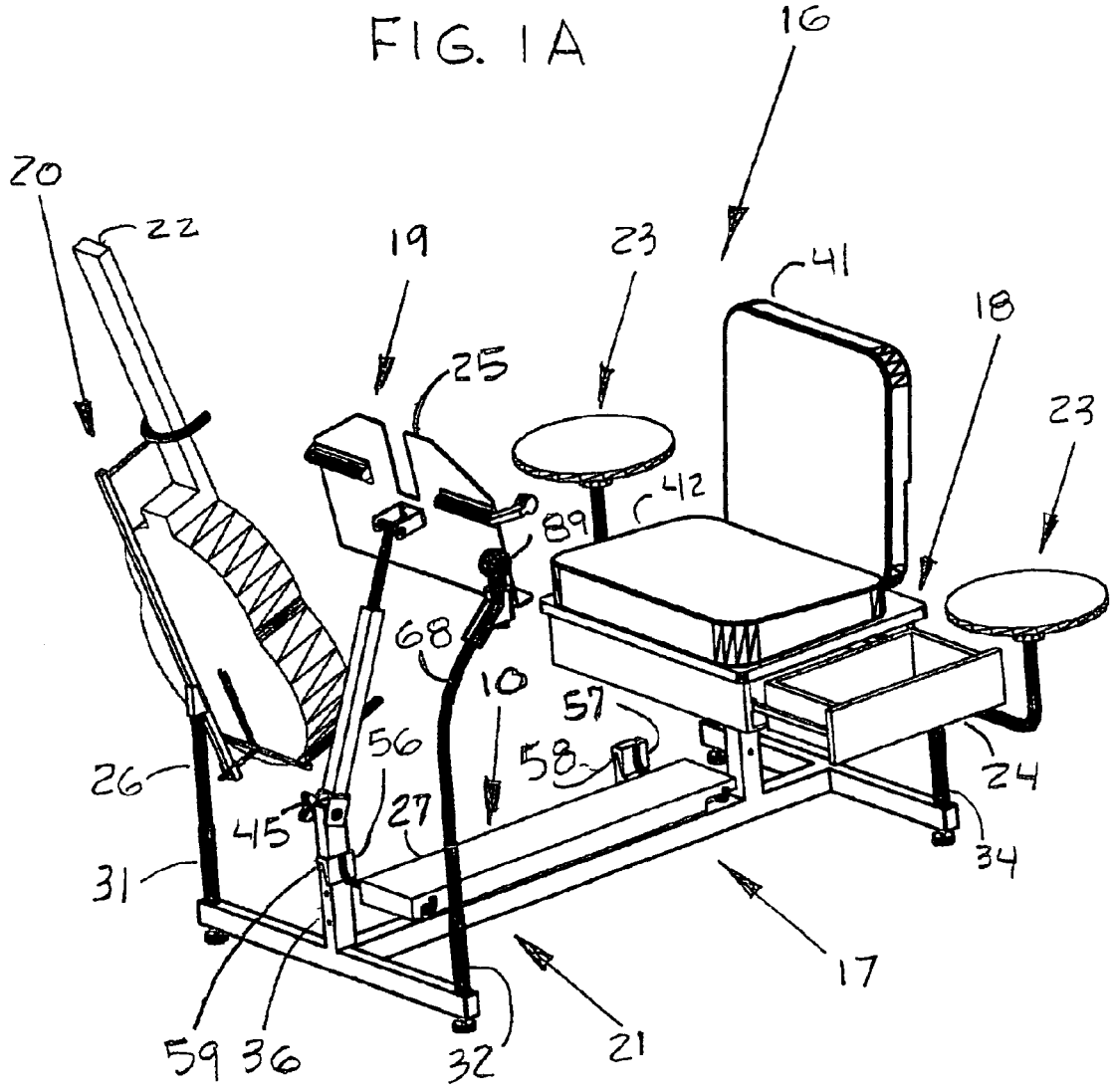
FIG. 1A is a left-side frontal prospective view of a portable utility stand constructed in accordance with an exemplary embodiment of the present invention. A mounted musical instrument is shown for clarity.
Figure 1B:
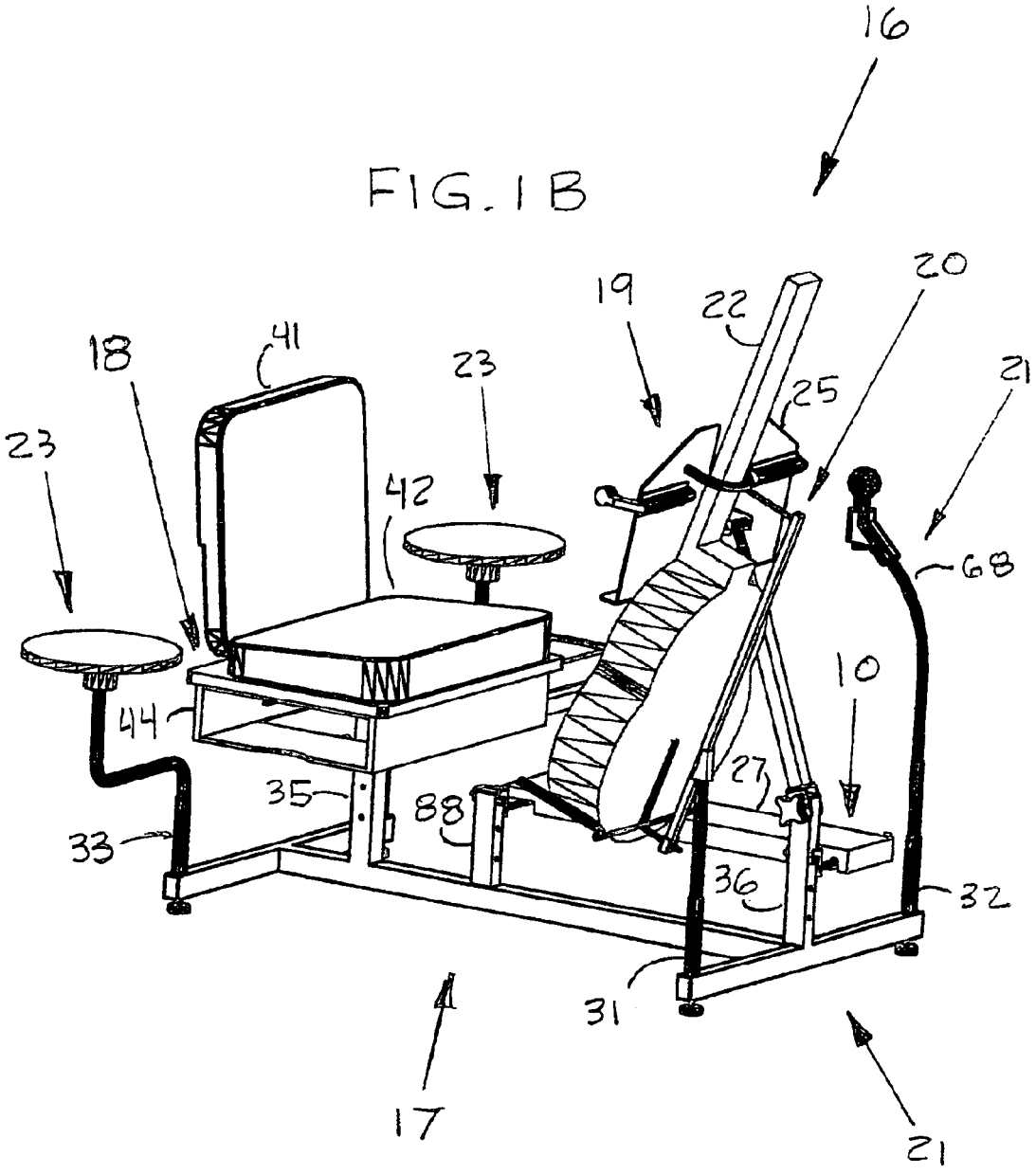
FIG. 1B is a right-side frontal prospective view of the utility stand. A mounted musical instrument is also shown for clarity.

The utility stand top assembly 16 is shown in FIG. 1A and FIG. 1B. The eight subassemblies that comprise the utility stand 16 include:

1. A base frame subassembly 17, see FIG. 4
2. A seating bench/storage subassembly 18, see FIG. 5A, FIG. 5B, and FIG. 5C
3. A sheet music support subassembly 19, see FIG. 8
4. A rotatable instrument support subassembly 20, see FIGS. 7A and 7B
5. An auxiliary equipment support subassembly 21, see FIG. 10
6. A foot rest subassembly 10, see FIGS. 6A and 6B
7. An auxiliary shelf subassembly 23, see FIG. 9
8. An extension arm subassembly 43, see FIGS. 2, 7A and 7B FIGS. 1A and 1B show the utility stand top assembly 16. The adjustable seating bench/storage subassembly 18 is shown with the drawer 24 open. The sheet music support subassembly 19 is shown with the platform 25 facing the seating bench/storage unit 18 where the user would be seated. The rotatable instrument support subassembly 20 is shown supporting an instrument 22 (a guitar in this case) on the rotatable instrument support stalk 26. The footrest subassembly 10 is shown with the foot platform 27 in the level position. The auxiliary equipment support subassembly 21 is shown supporting a microphone 89 in this particular case. Two auxiliary shelf subassemblies 23 are shown along side the storage unit seating bench/storage assembly 18. The equipment is mounted on frame subassembly 17, seating bench/storage subassembly 18 is shown installed in seat receptacle 35. The rotatable instrument support subassembly 20 is shown installed in receptacle 31. The auxiliary shelf subassembly 23 is shown installed receptacle 34 in FIG. 1A. The auxiliary shelf subassembly 23 is shown installed in receptacle 33 in FIG. 1B. The auxiliary equipment support subassembly 21 is shown installed in receptacle 32. The footrest subassembly 10 is shown mounted to the frame subassembly 17 on support receptacles 88 and support receptacle 36. Support receptacle 88 supports foot support bracket 57 on pin 58. Support receptacle 36 supports foot support bracket 56 on pin 59. Height and tilt adjustment of footrest subassembly 10 is achieved by adjusting pins 58 and 59.

FIGS. 1A and 1B also show the upper seat cushion 41 and the lower seat cushion 42. Storage shelf 44 shown in FIG. 1B is a part of the seating bench storage subassembly 18 shown in FIGS. 5A, 5B, and 5C. The drawer 24 (shown open) and the shelf 44 are reversible. The sheet music subassembly 19 is tilted forward. The auxiliary equipment support 21 is shown with a microphone adjusted forward on the gooseneck 68.

Figure 1C:
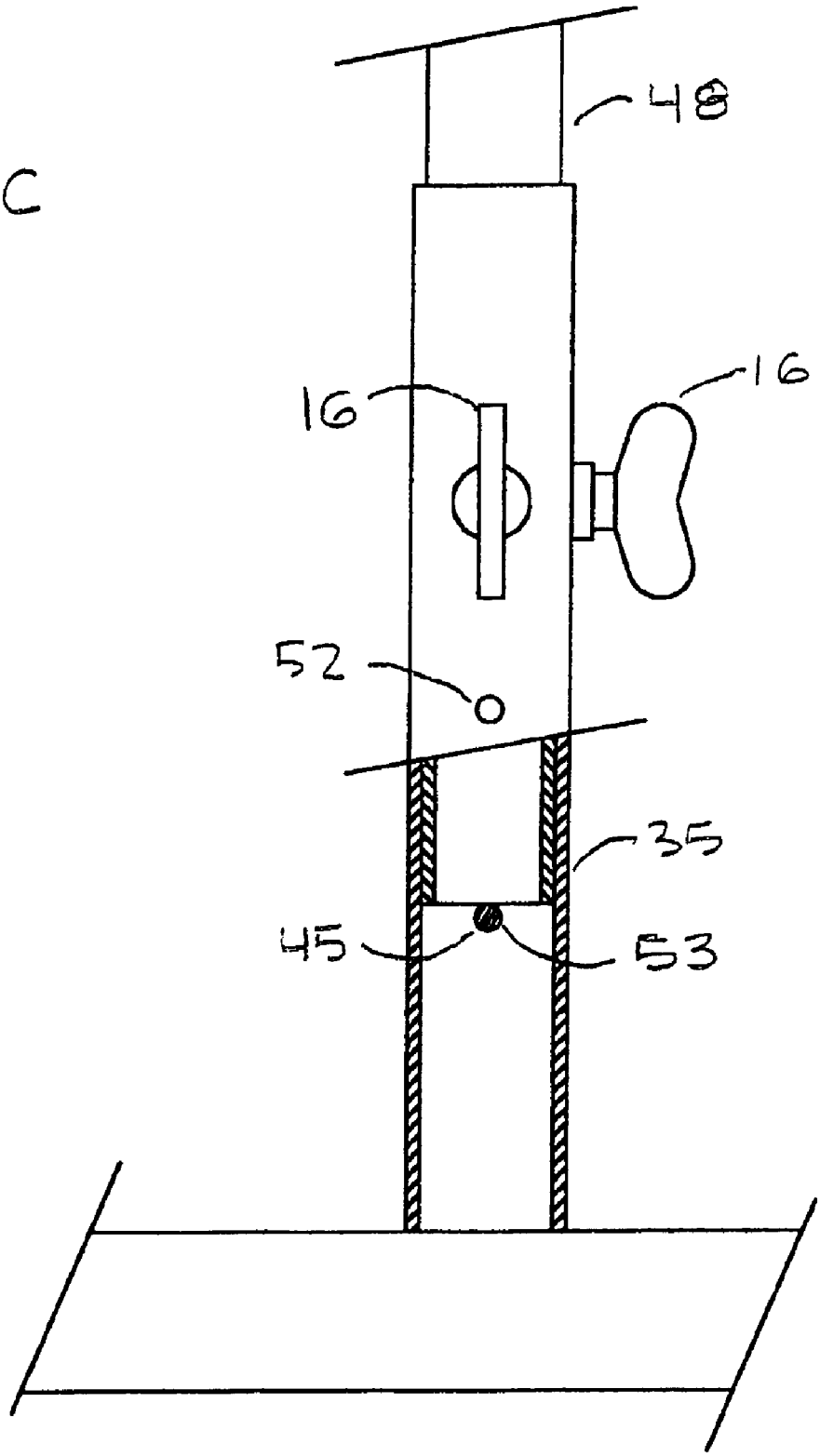
FIG. 1C is a frontal view showing the seating bench/storage assembly height adjustment means.

FIG. 1C shows an exemplary method of adjusting the seat bench/storage subassembly 18 height. Support bracket 48 is supported by pin 45 in hole 53. The seating bench/storage subassembly 18 is supported by pin 45. Moving pin 45 to hole 52 raises the seating bench/storage subassembly 18. Clamping means 16 two places are tightened to eliminate clearance between receptacle 35 seat support 48.

Figure 2:
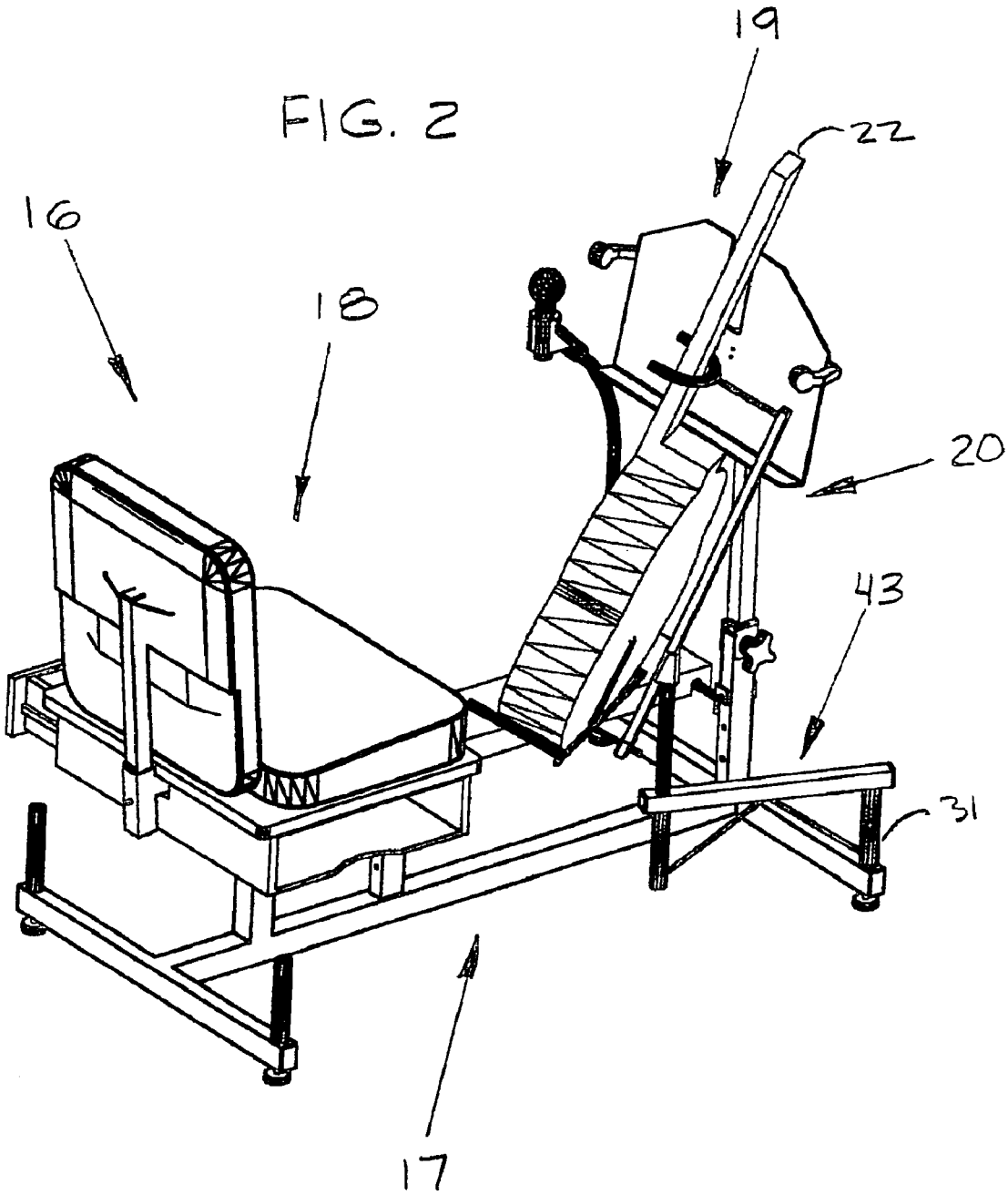
FIG. 2 is a right-side rear prospective view of the utility stand with a rotatable extension arm for the instrument support.

FIG. 2 shows the rotating extensions arm 43 installed over receptacle 31. The extension arm 43 supports the rotatable instrument subassembly 20. The extension arm 43 rotates about receptacle 31 in this case This allows the instrument 22 to be positioned closer to the user. In addition the instrument 22, can be rotated out of the way on 43 to a protected position between the seating bench/storage subassembly 18 and the sheet music support subassembly 19

Figure 3A:
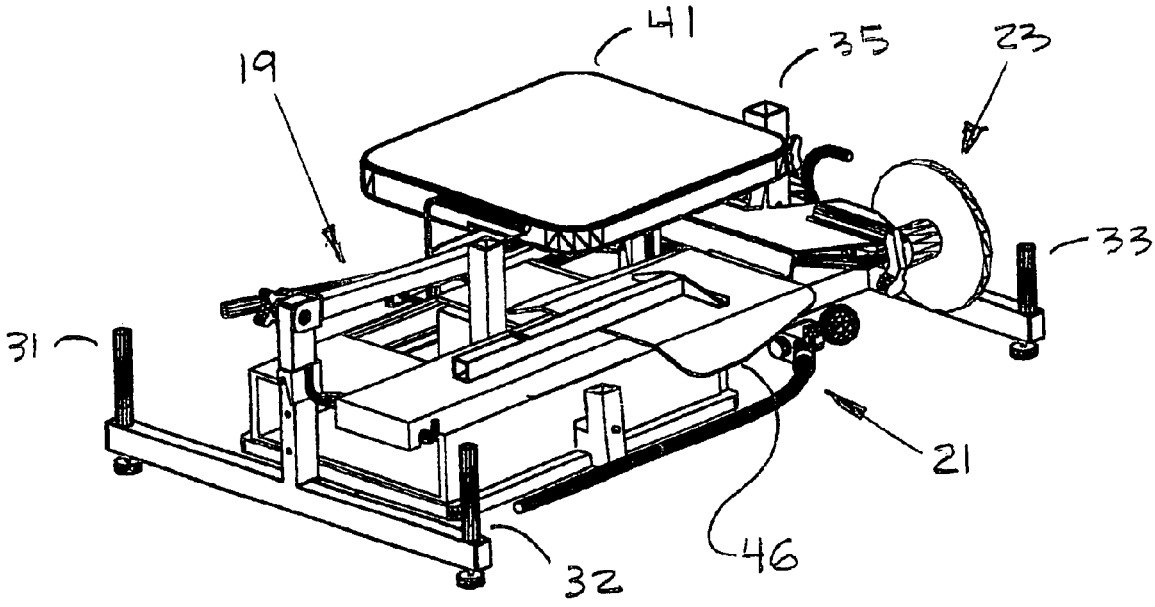
FIG. 3A is a collapsed left-side frontal prospective view of the utility stand.

FIG. 3A shows a left-hand frontal prospective view of the utility stand collapsed for transport or storage. The sheet music support assembly 19 rotates to a substantially horizontal position. The remaining component parts lift out of their respective receptacles 31, 32, 33, 34, and 35. They are then packed substantially horizontal in a transport case. The Transport case is not shown for clarity.

Figure 3B:
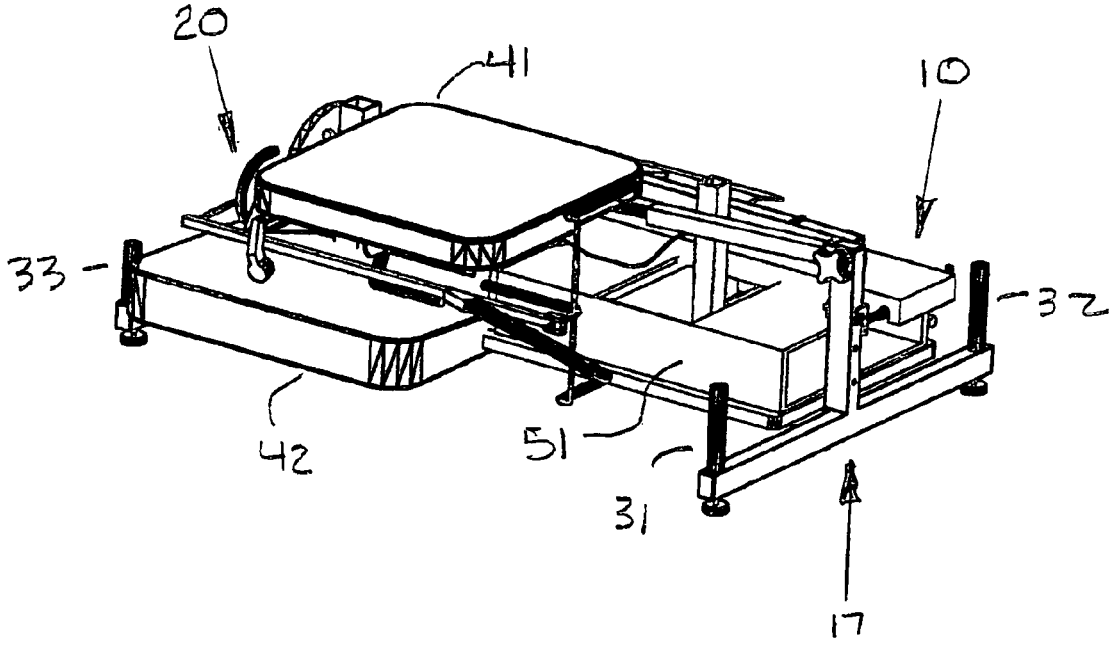
FIG. 3B is a collapsed right-side frontal prospective view of the utility stand.

FIG. 3B shows a right-hand frontal prospective view of the utility stand collapsed for transport or storage. The Transport case is not shown for clarity.

Figure 4:
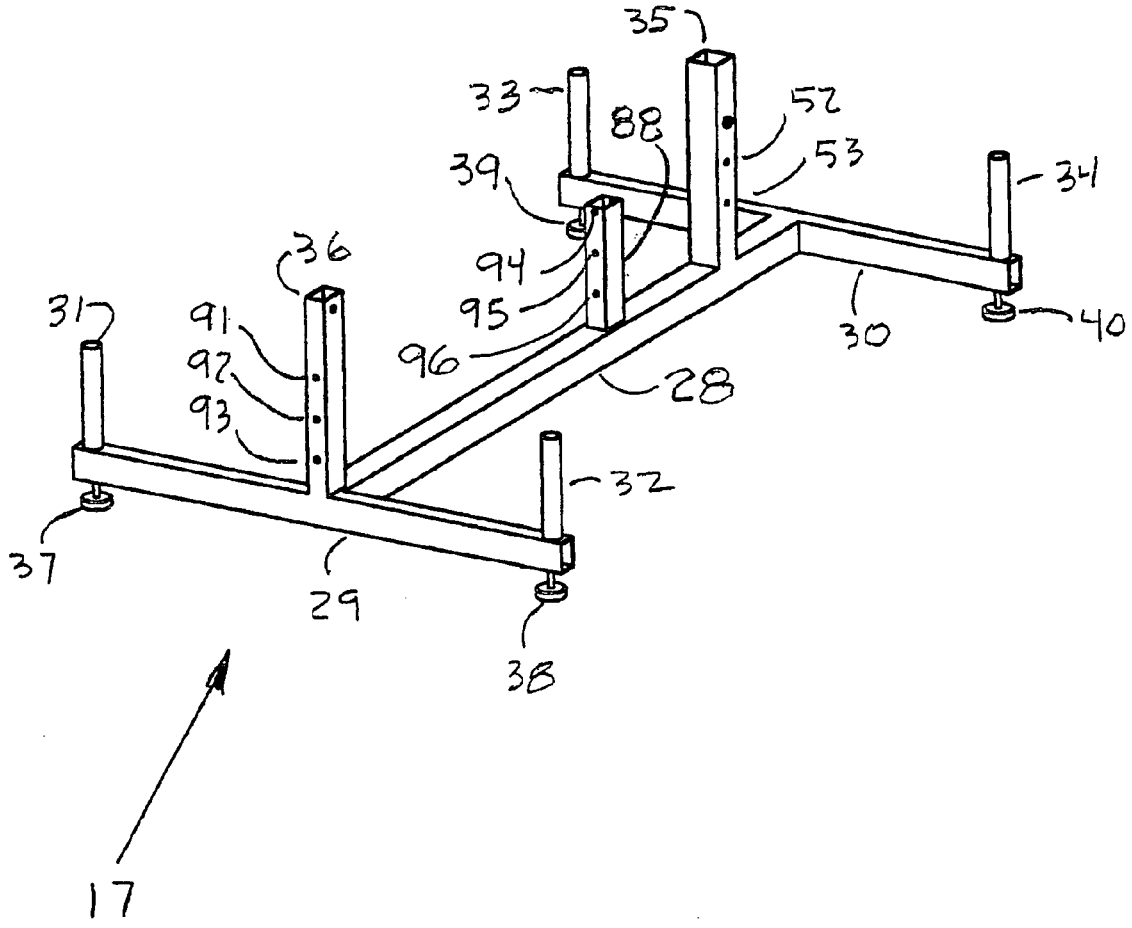
FIG. 4 is a left-side frontal prospective view of the base frame subassembly.

FIG. 4 shows the base frame subassembly 17 is comprised of a center member 28, a front member 29 and a rear member 30 substantially attached to the center member 28. At each end of the front member 29 are receptacles 31 and 32. At each end of the rear member 30 are receptacles 33 and 34. Seat receptacle 35, footrest support 36, and lower footrest support 88 are attached to center member 28. Footrest support 36 has pinholes 91, 92, and 93 used to adjust the footrest support subassembly 10 height. Footrest support 88 has pinholes 94, 95, and 96 to adjust the height or tilt of footrest subassembly 10. Floor glides 37 and 38 are adjustably fastened to the lower side of front member 29. Floor glides 39 and 40 are adjustably fastened to the lower side of rear member 30. Pinhole 52 and pinhole 53 are shown in seat receptacle 35. The use of these pinholes to adjust the height of the seating bench/storage subassembly 18 is shown in FIG. 1C.

Figure 5A:
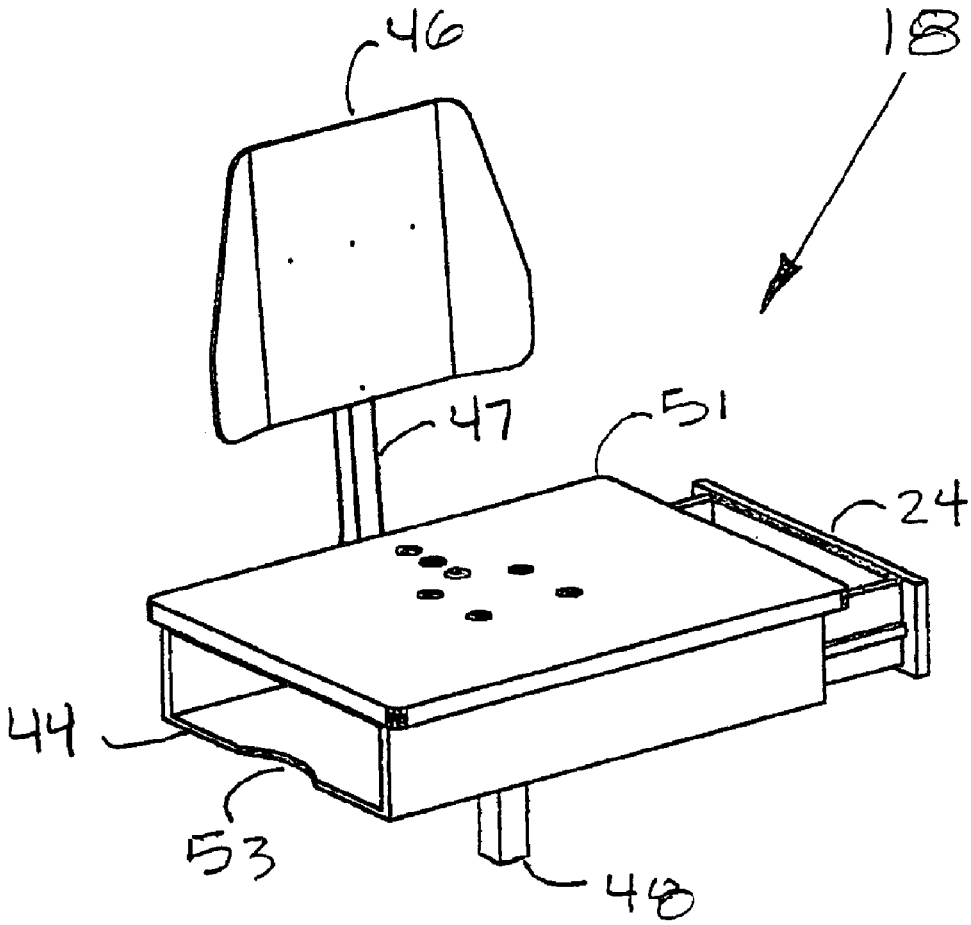
FIG. 5A is a right-side frontal prospective view of the seating bench/storage subassembly.
Figure 5B:
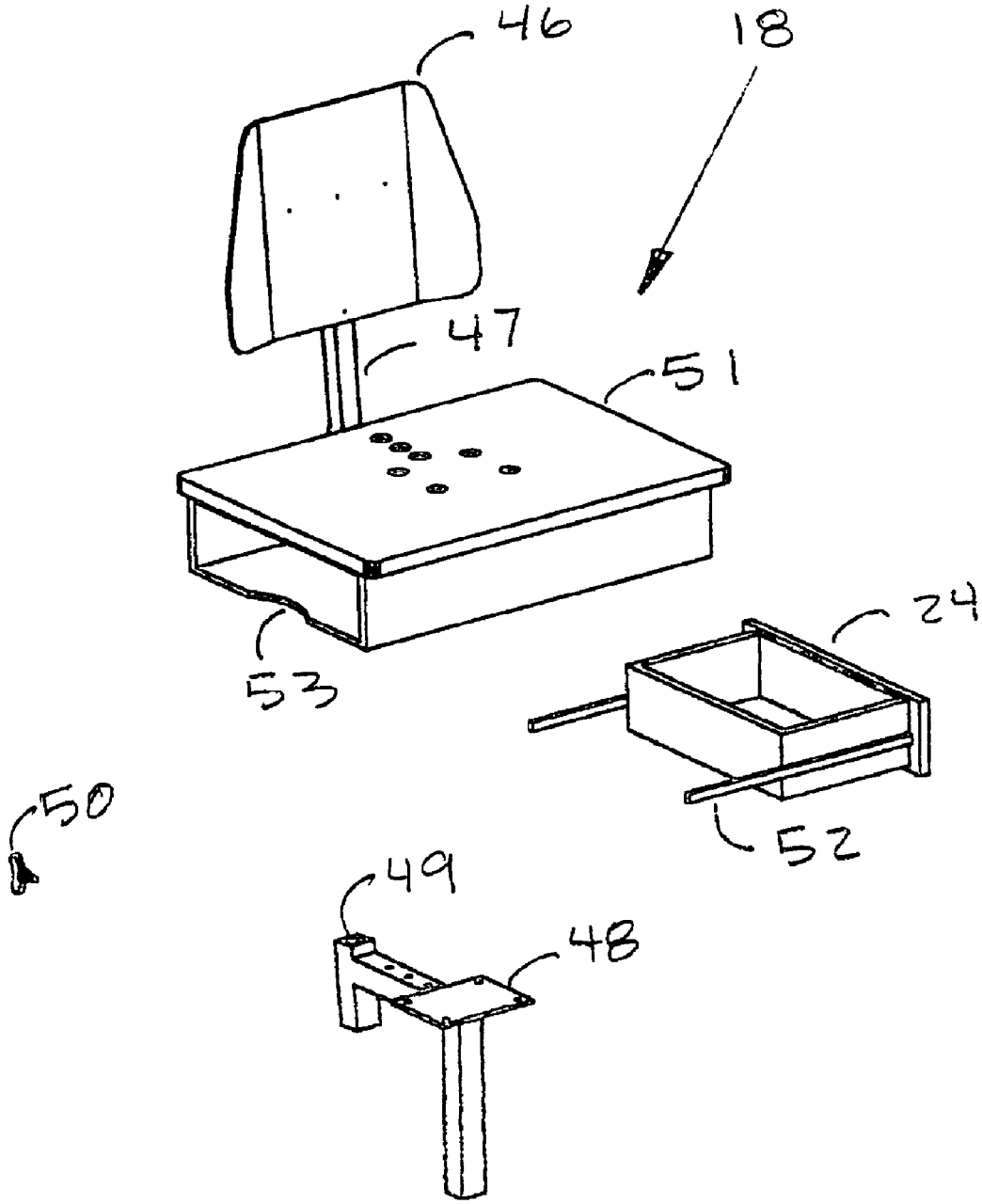
FIG. 5B is an exploded right-side frontal prospective view of the seating bench subassembly.
Figure 5C:
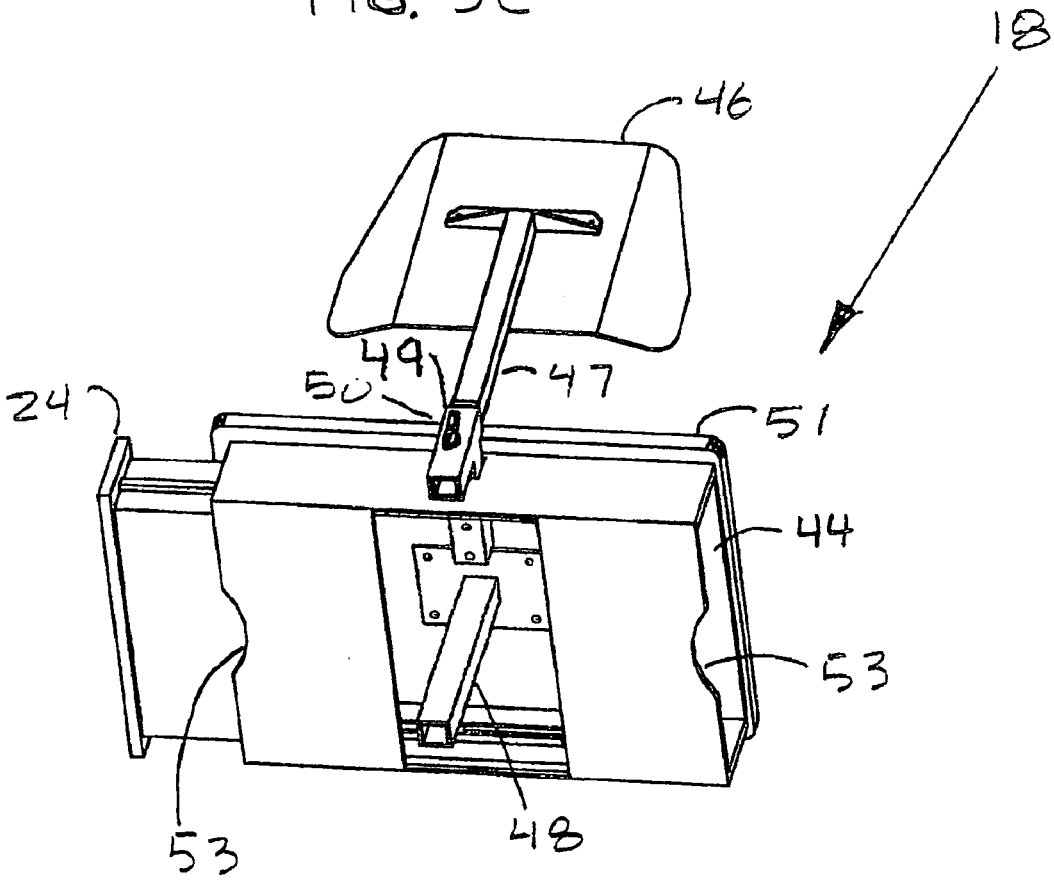
FIG. 5C is a right-side, rear bottom prospective view of the seating bench subassembly.

FIG. 5A, FIG. 5B, and FIG. 5C show the seating bench/storage assembly 18. The seat back rest 46 is slightly curved to conform to the users back and fastened to back support 47. The back support 47 is inserted into the backrest support bracket 49 and secured with a clamping means 50. The backrest support bracket 49 is secured to the bench/drawer structure 51. The support bracket 48 is also secured to the bench/drawer tubular structure 51. The support bracket 48 is inserted into the seat receptacle 35 attached to the base frame assembly 17 shown in FIG. 4.

FIG. 5B an exploded view provides a better understanding of the basic components of the seating bench/storage unit 18. The drawer 24 slides on commonly used drawer slides 52.

FIG. 5C shows a bottom right rear view of the bench/storage assembly 18. Finger griping recess 53 allows the drawer to be pulled open and facilitates reference material removal from storage 44.

Figure 6A:
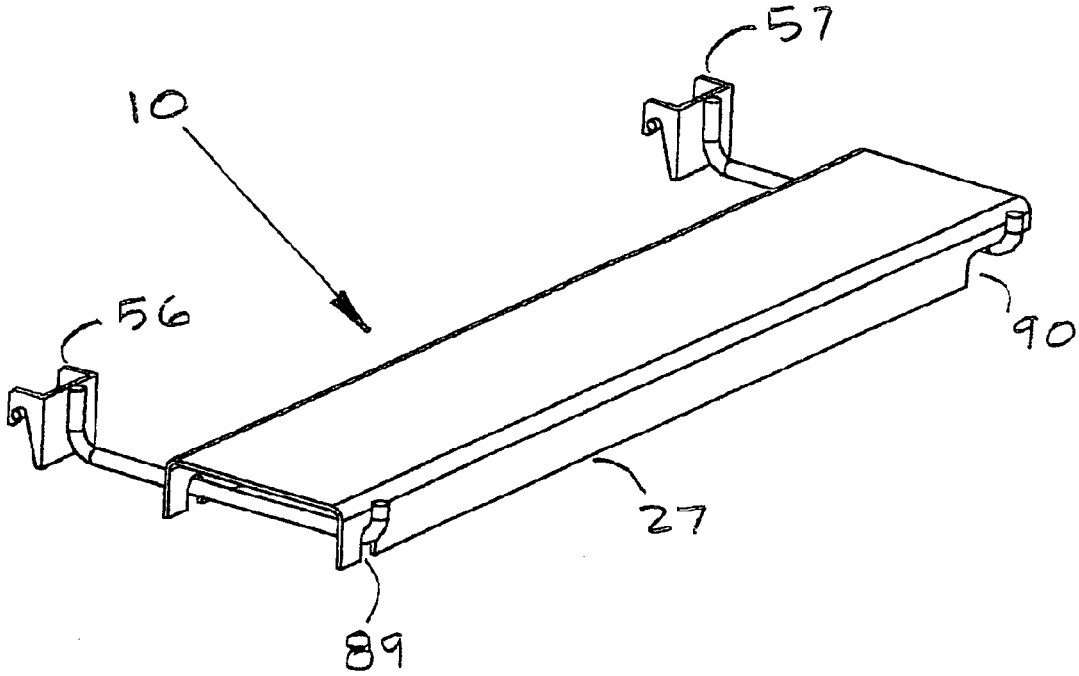
FIG. 6A and is a left-side prospective view of the foot rest subassembly.

FIG. 6A shows the footrest subassembly 10 is comprised of the footrest platform 27, forward support bracket 56, and rear support bracket 57. The forward support bracket 56 is engaged in a slot 89. The rear support bracket 57 supports footrest platform 27 on flat 90. FIG. 1A and FIG. 1B show the support means: support bracket 56 is supported by pin 59 engaged in 36 and support bracket 57 is supported by pin 58 engaged in 88.

Figure 6B:
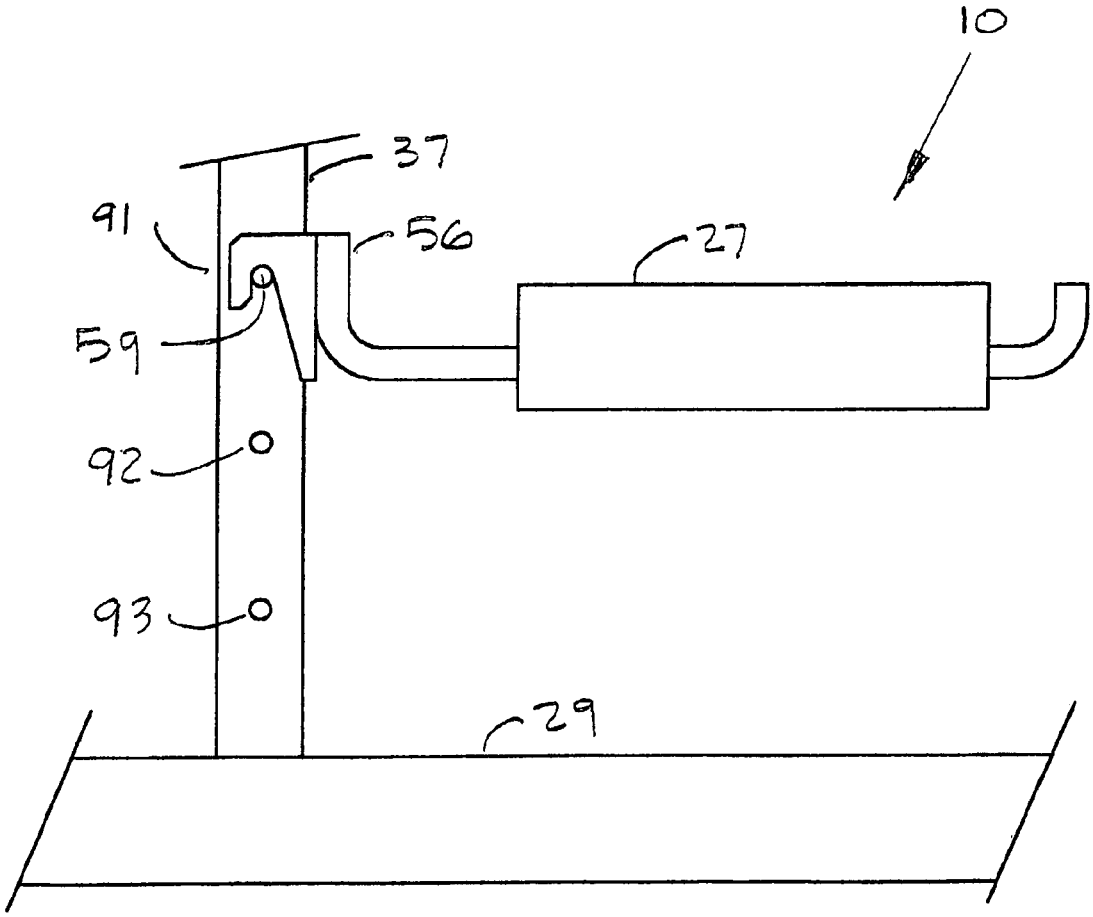
FIG. 6B is a partial frontal view of the footrest mounting.

FIG. 6B shows the support and adjustment means the footrest subassembly 10. Pin 59 is shown installed in pinhole 91. Footrest subassembly 10 height and tilt adjustment is achieved by moving pin 59 shown in hole 91 to holes 92 or 93 in cooperation with pin 58 and holes 94, 95, or 96.

Figure 7A:
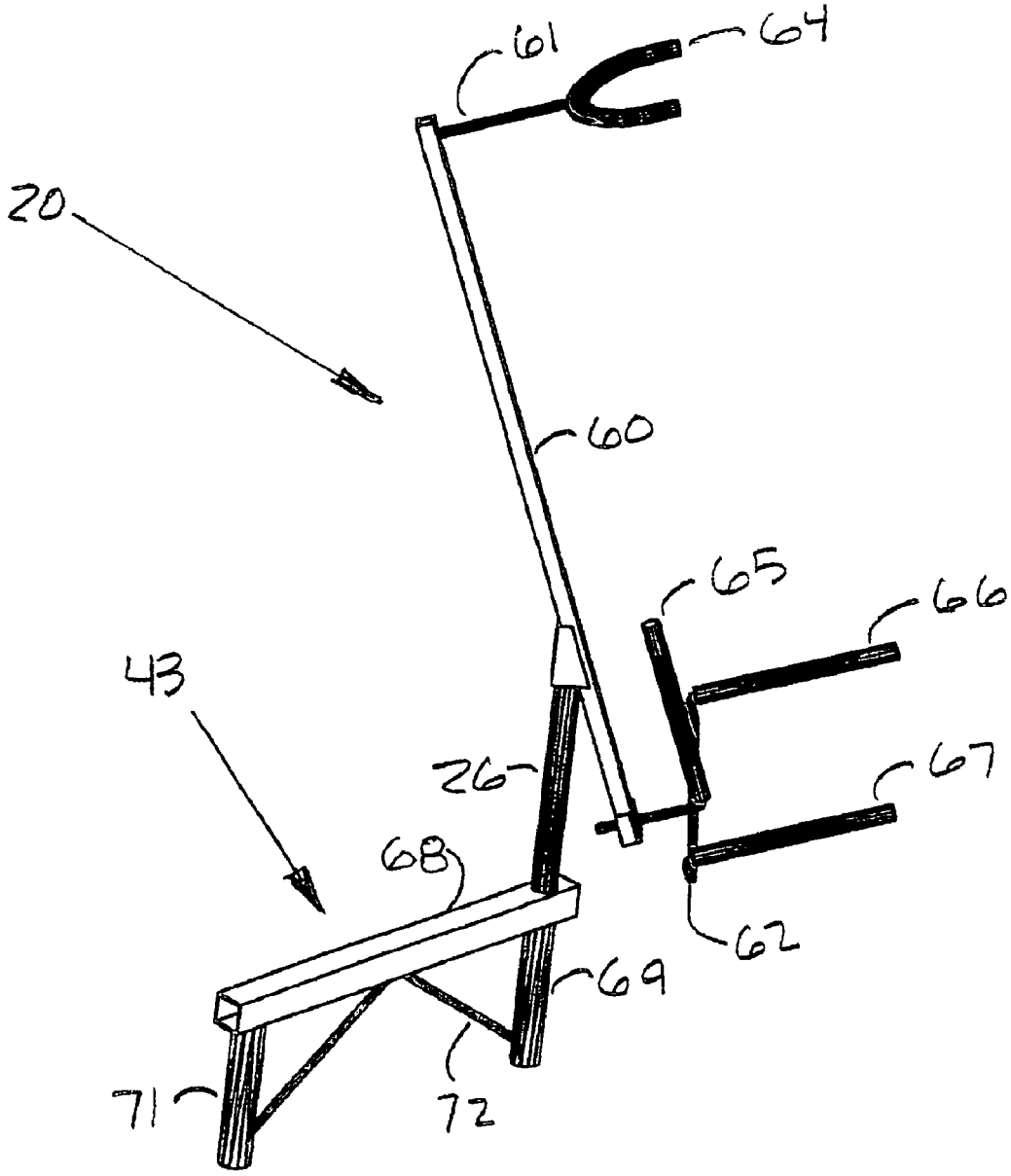
FIG. 7A is a right-side prospective view of the instrument support subassembly.

FIG. 7A shows the rotatable support unit 20 installed in extension arm 43.

Figure 7B:
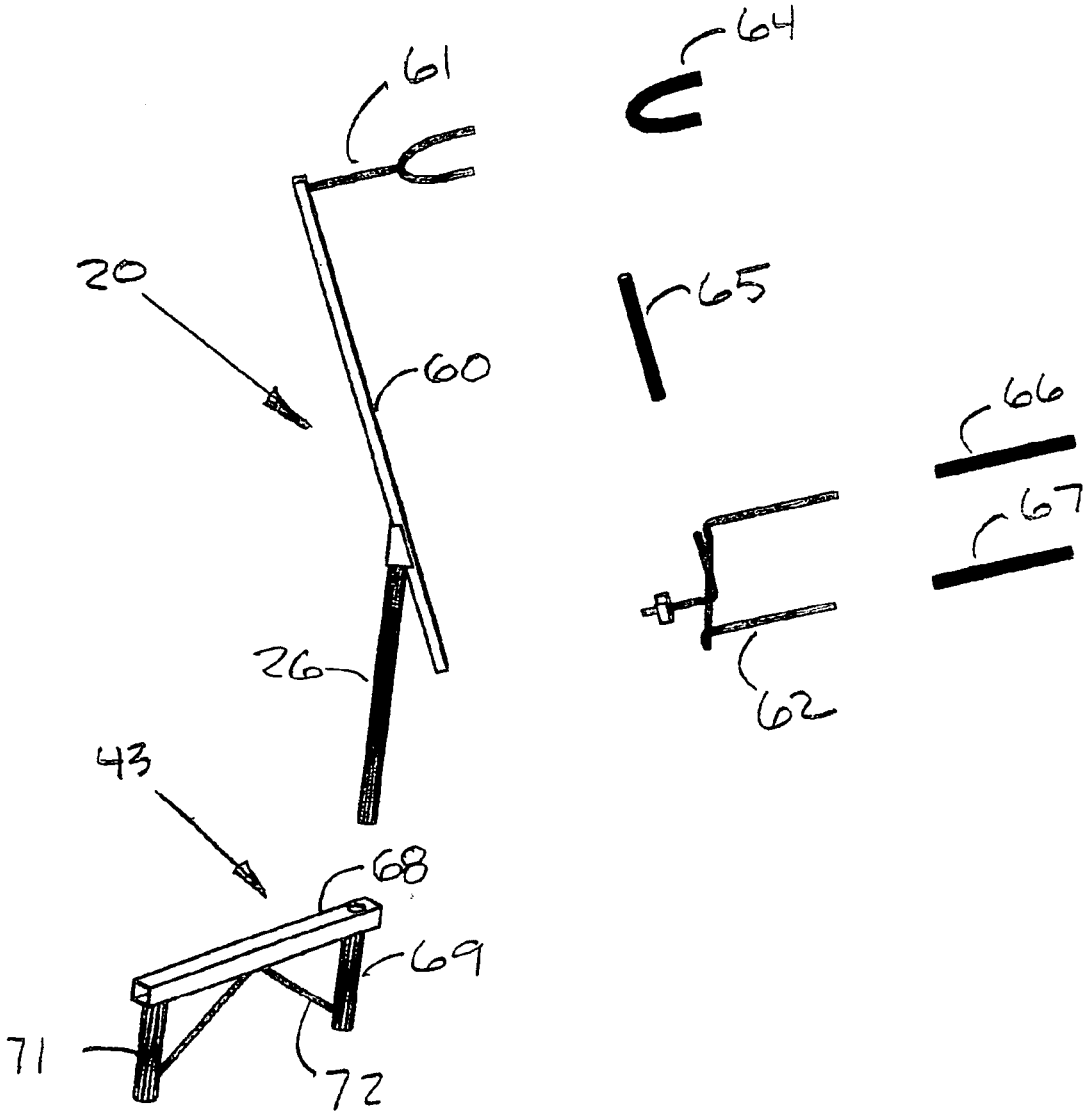
FIG. 7B is an exploded right-side prospective view of the instrument support subassembly.

FIG. 7B shows an exploded view of the rotatable support assembly 20 with extension arm 43. The rotatable instrument support stalk 26 is substantially fastened to tilted post 60. The upper fork rest 61 cradles the instrument fingerboard. The upper fork rest 61 is substantially fastened to the tilted post 60. The upper fork rest 61 is preferably round stock, covered with a soft material covering 64. The soft material covering 64 preferably conforms to the fork rest 61 and is split to allow assembly over the upper fork rest 61. The instrument is vertical support fork 62 is preferably round stock and configured to support the instrument vertically and horizontally with three legs of the upper vertical support fork 62. The three legs are covered with a soft material covers 65, 66, and 67. The fourth leg of the vertical support fork 62 attaches to the tilted post 69. The extension arm unit 43 is composed of a horizontal beam 68, with receptacle 60 and receptacle 71. Stiffening member 72 substantially joined to the horizontal beam 69, and receptacles 69, and 71. The instrument support stalk 26 is inserted inside receptacle 69. The extension arm 43 is shown installed on the base frame unit 17 over receptacle 31 however, it could be installed over receptacles 32, 33, or 34 depending on user preference.

Figure 8:
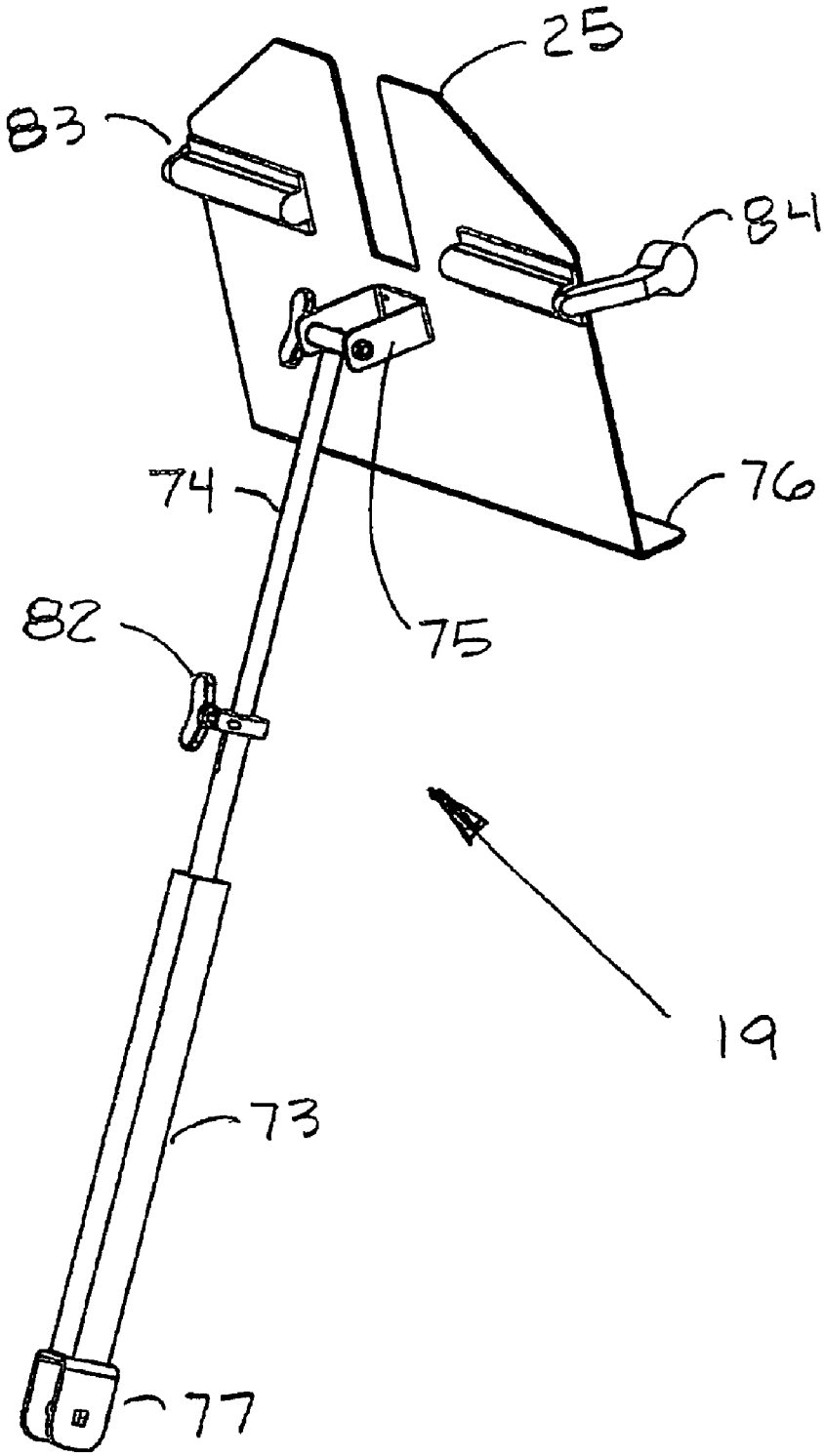
FIG. 8 is right-side rear view of the sheet music support post subassembly with extension arm

FIG. 8 shows the sheet music support 19. The sheet music support subassembly 19 consists of a lower column section 73 and a telescoping section 74. Mounted on top of the telescoping section 74 is a bracket 75 that pivotably supports the sheet music support 76. As indicated in FIG. 1 the sheet music support subassembly 19 is rotationally coupled to footrest support 36 through bracket 77 and secure with clamping means 45. The telescoping section 74 is held in position with clamping means 82. The sheet music support 25 is formed with a protruding ledge 76 to support reference material and illuminated with lamps 83 and 84.

Figure 9:
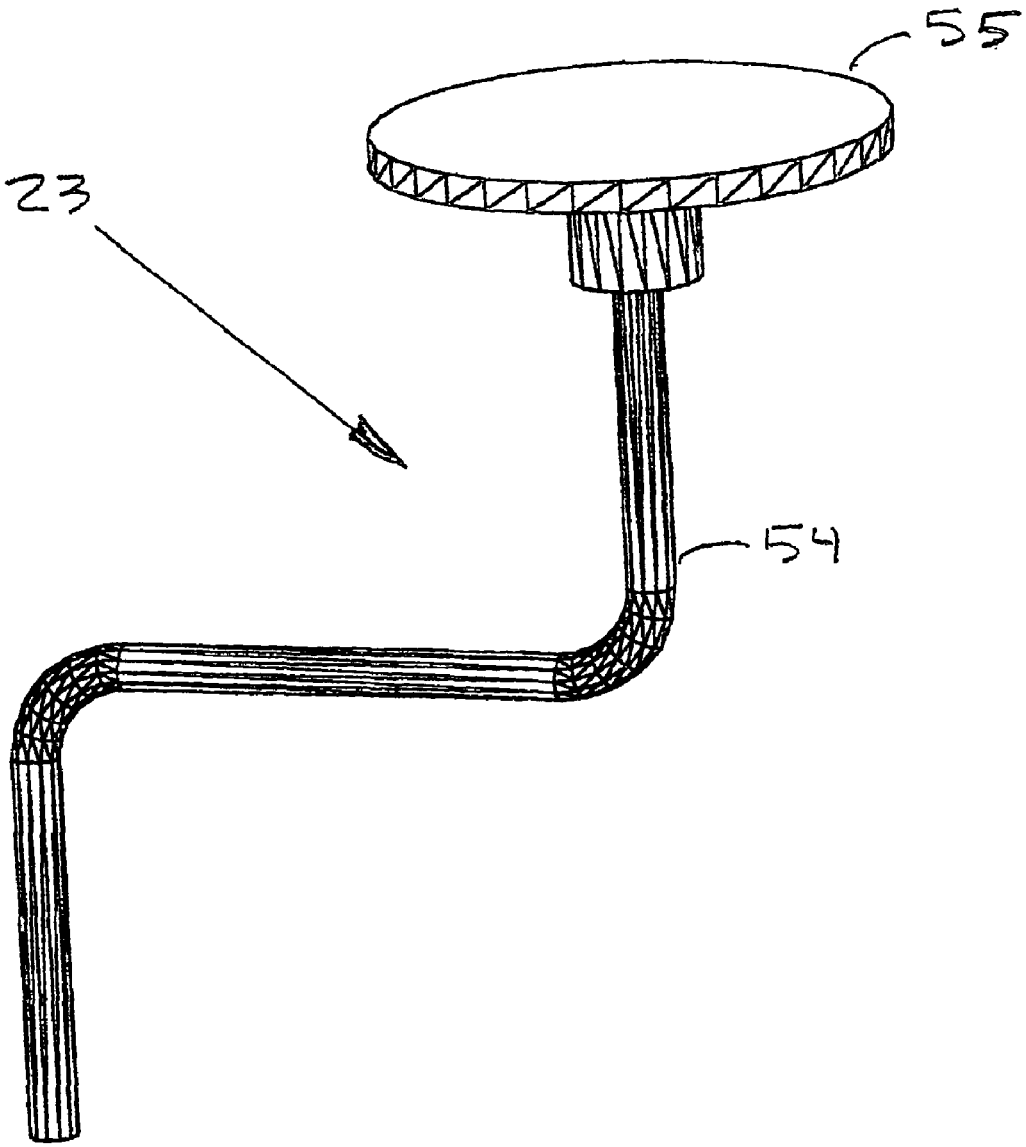
FIG. 9 is an upper prospective view of the accessory shelf subassembly.

FIG. 9 shows the auxiliary shelf unit 23. The auxiliary shelf 23 is composed of a preferably round support member 54, and shelf 55. The support member 54 is rotationally coupled to the shelf 55.

Figure 10:
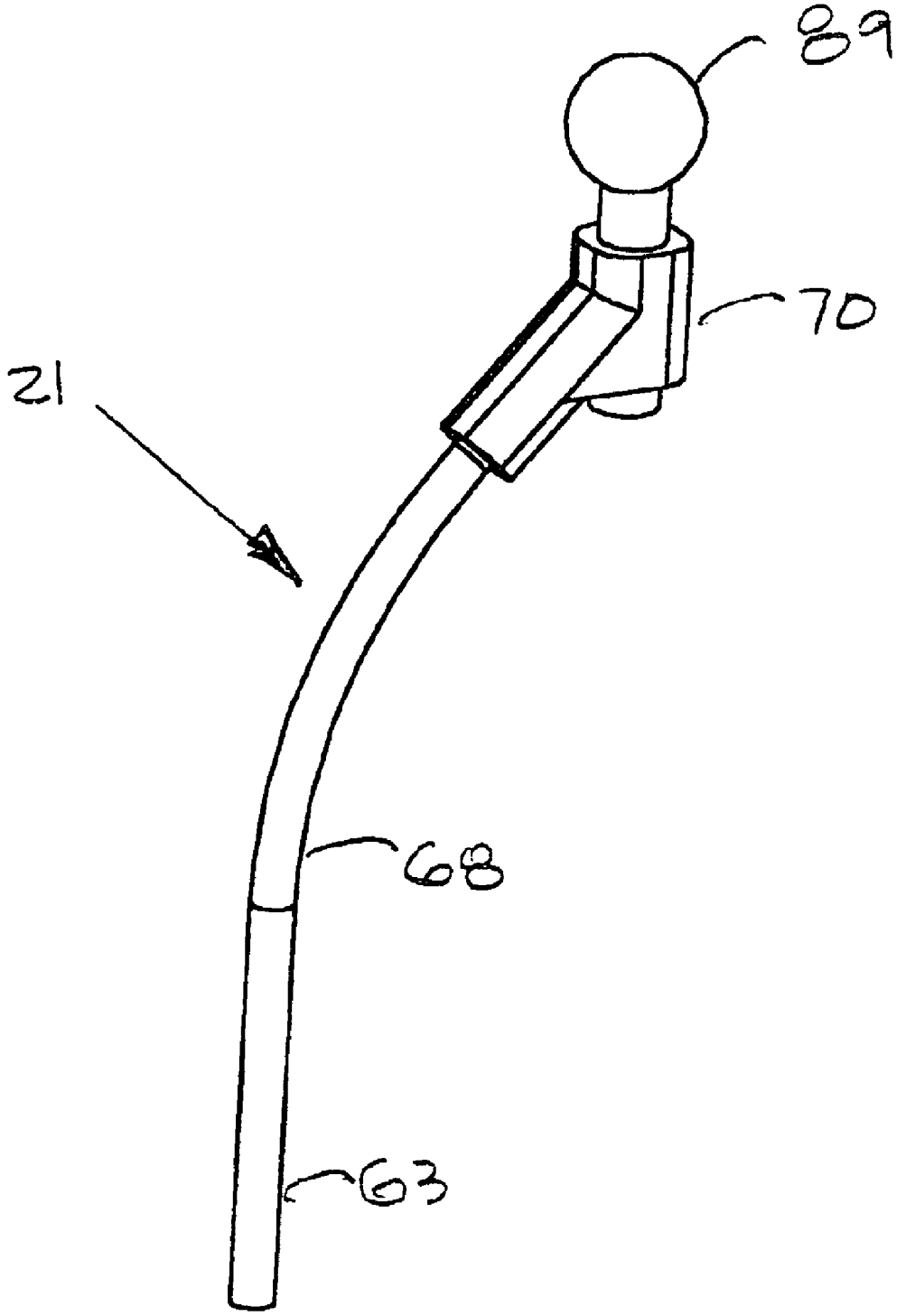
FIG. 10 is prospective view of the auxiliary equipment support subassembly with an exemplary microphone.

FIG. 10 shows the auxiliary equipment support unit 21 that is composed of three components: a lower support member 63, a flexible gooseneck 68, and receptacle 70. A microphone 89 is shown installed in receptacle 70. However the receptacle 70 is removably mounted to the gooseneck 68. A receptacle suitable for mounting an instrument tuning device, telephone, or other device could be installed on the gooseneck 68. The auxiliary equipment support subassembly 21 is shown rotationally mounted to the base frame subassembly 17 on receptacle 32 in FIG. 1A and 1B but could be installed on any receptacle as discussed earlier.

Figure 11A:
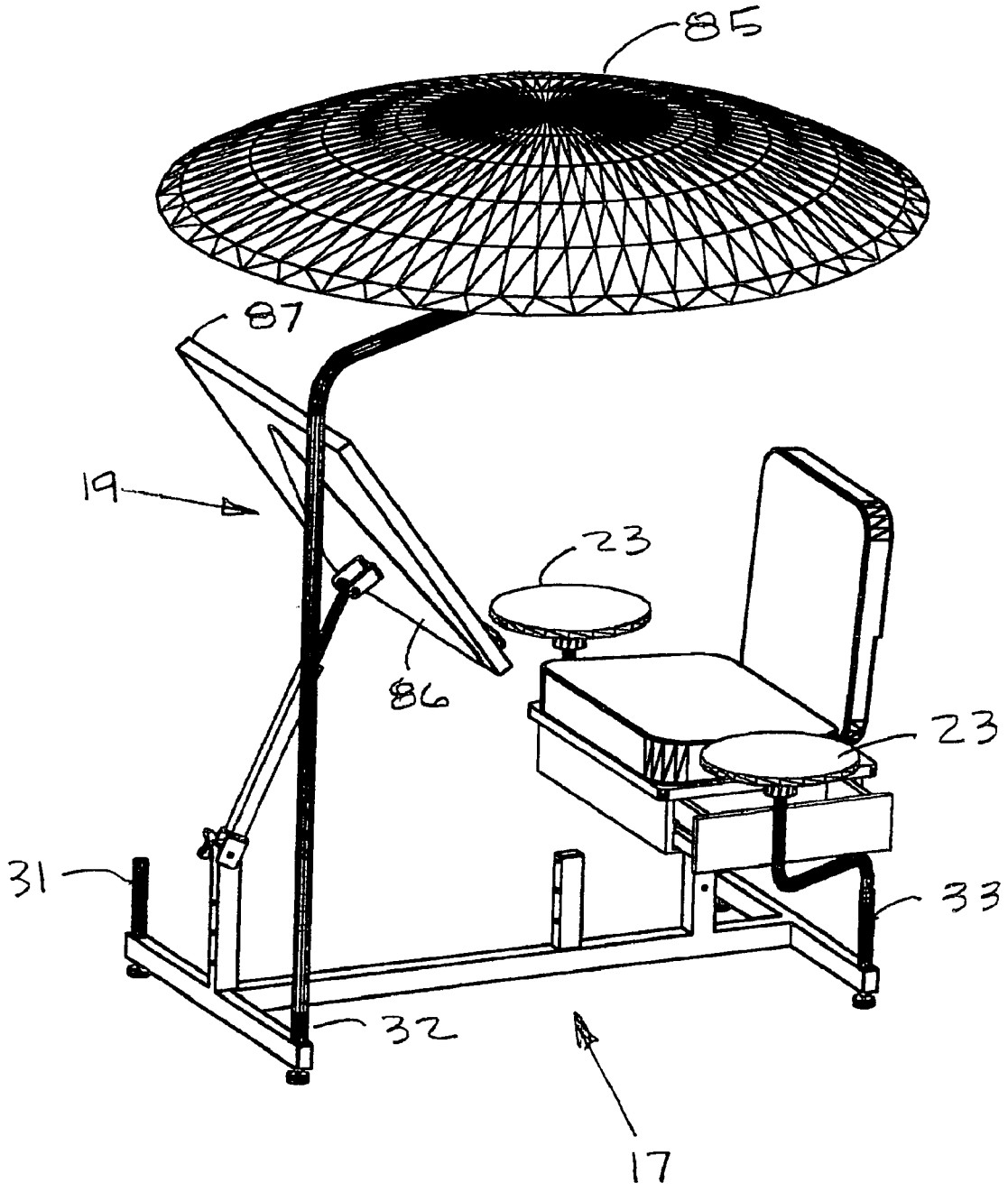
FIG. 11A is a left-side rear prospective view of the utility stand adapted for an artist.
Figure 11B:
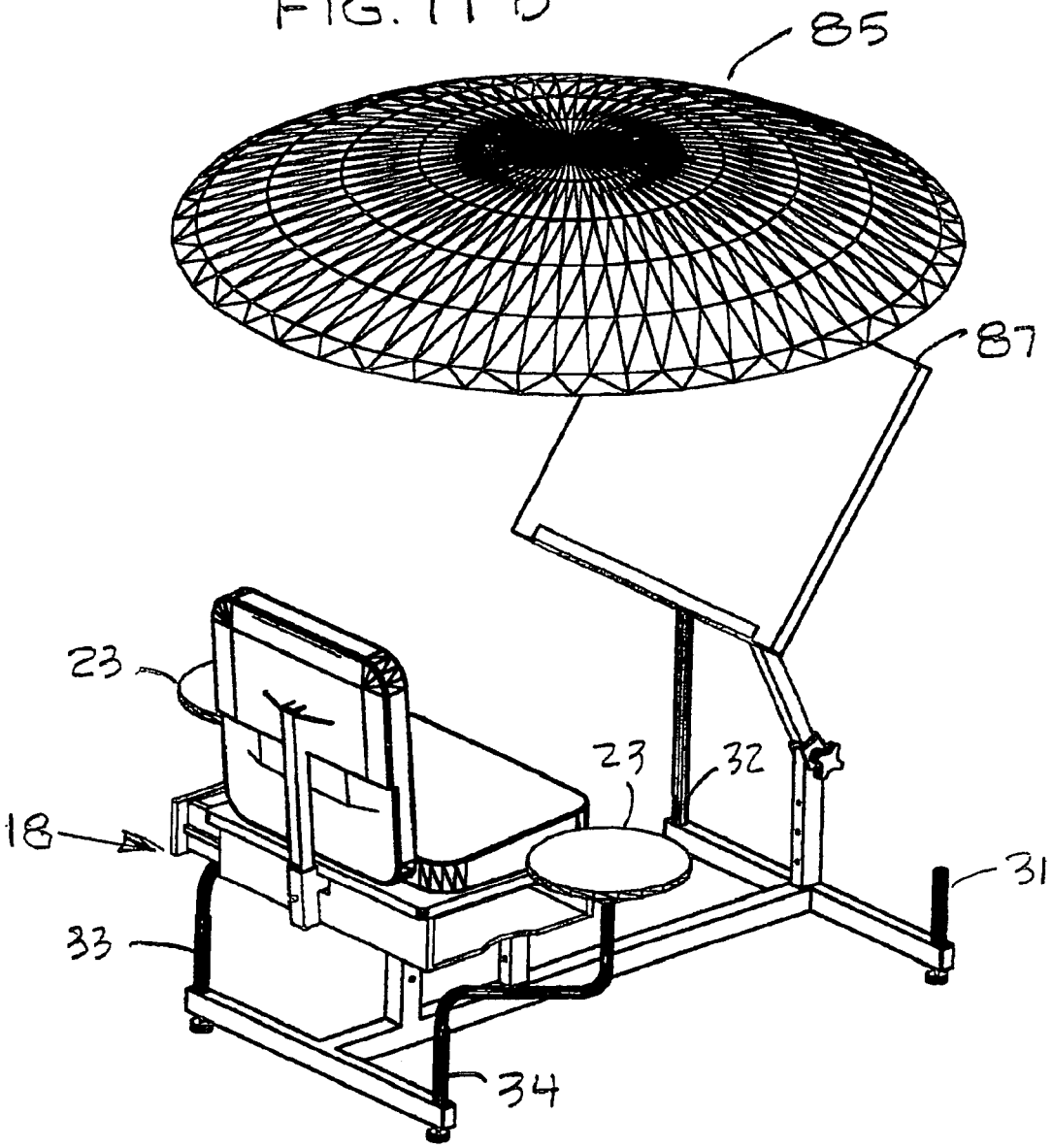
FIG. 11B is a right-side rear prospective view of the portable utility stand adapted for an artist.

FIGS. 11A and 11B shows the portable utility stand adapted for an artist or surveyor. The easel 86 is shown supporting art 87. The easel 86 replaces platform 25 on the music sheet support subassembly 19. The frame subassembly 17 is unaltered. An auxiliary shelf subassembly 23 is installed in receptacle 33 and receptacle 34. Umbrella 85 is shown installed in receptacle 32.

Figure 12A:
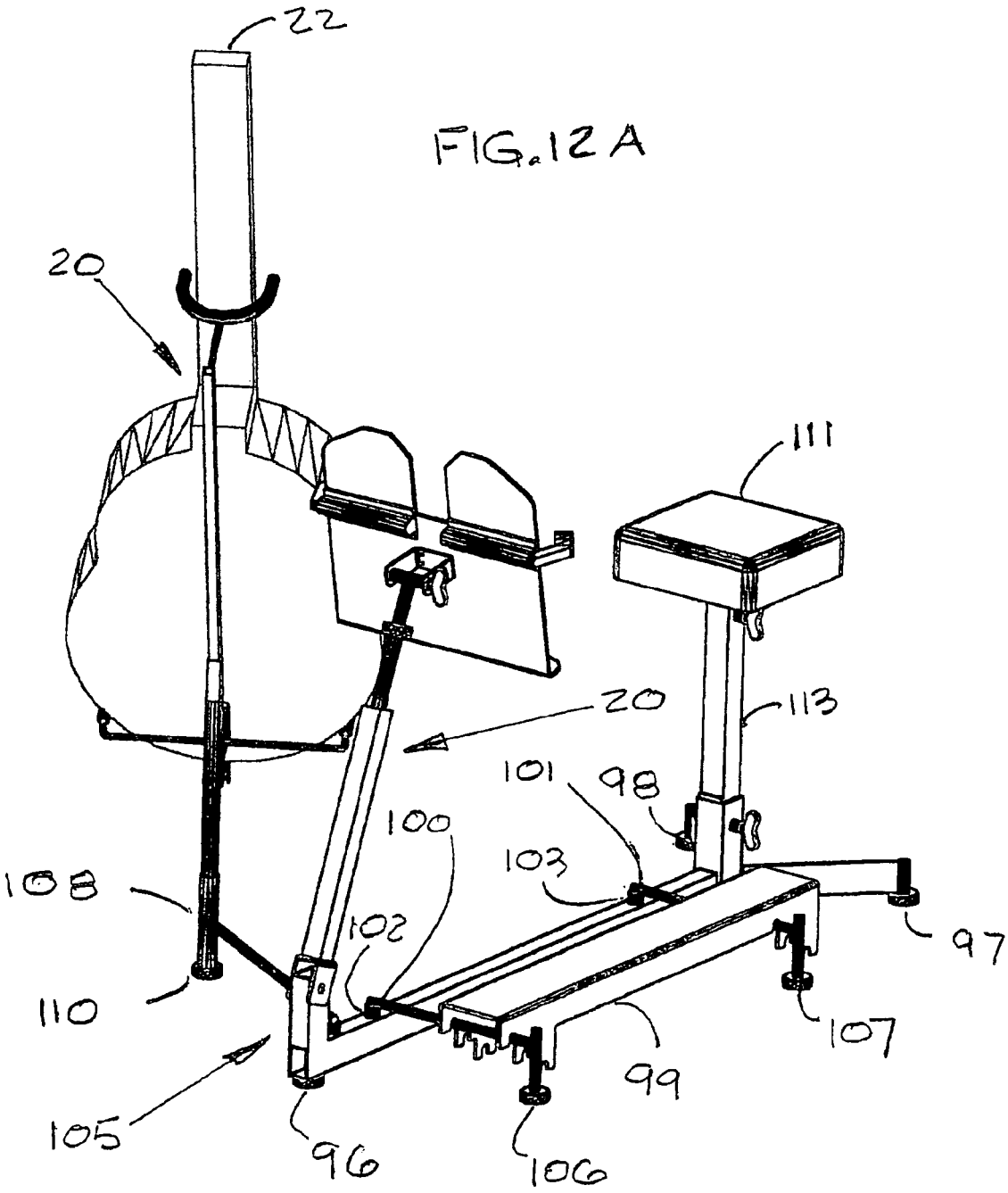
FIG. 12A is a left-side frontal prospective view of a compact version of the portable utility stand.
Figure 12B:
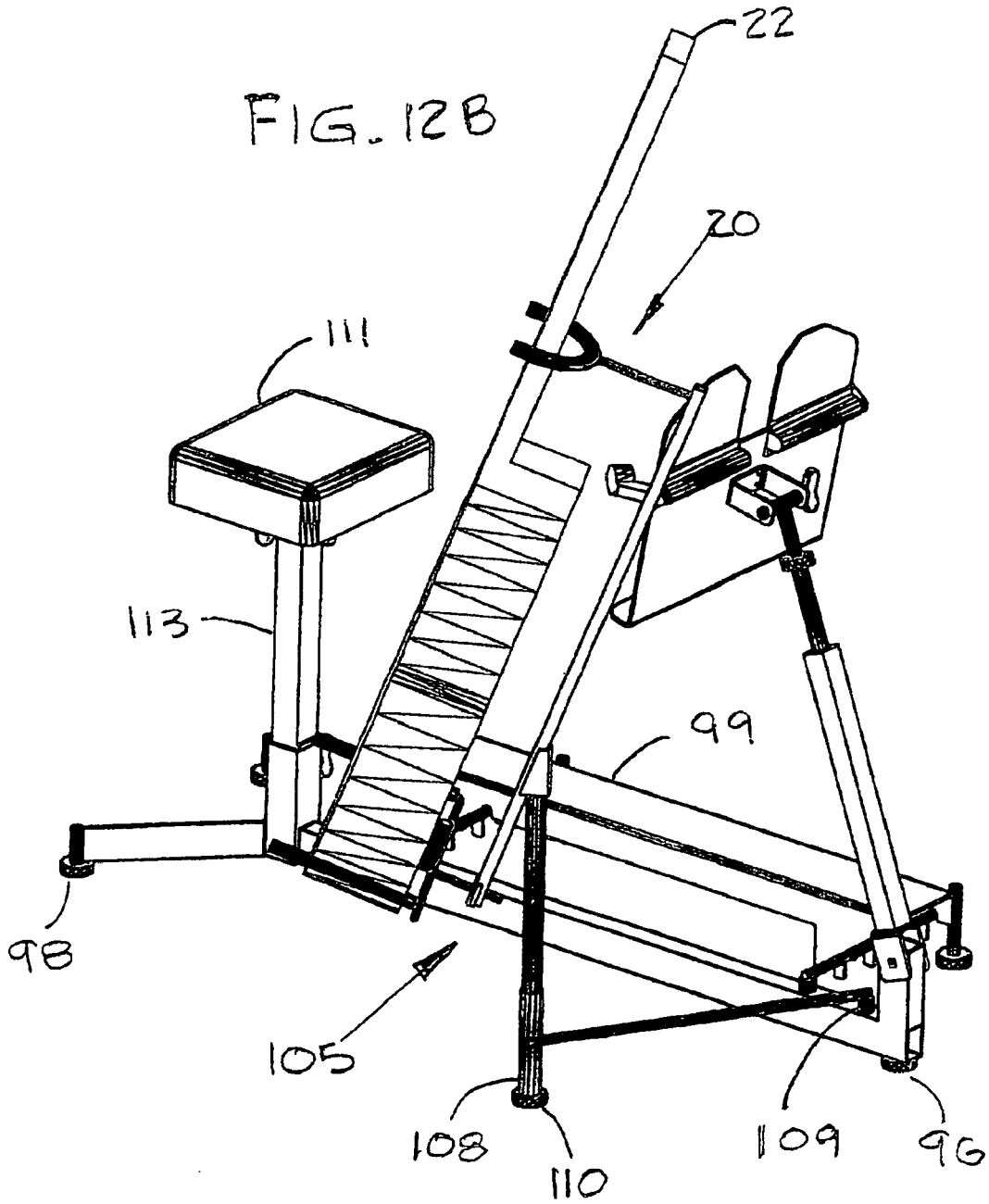
FIG. 12B is a right-side frontal prospective view of the compact version of the portable utility stand.
Figure 12C:
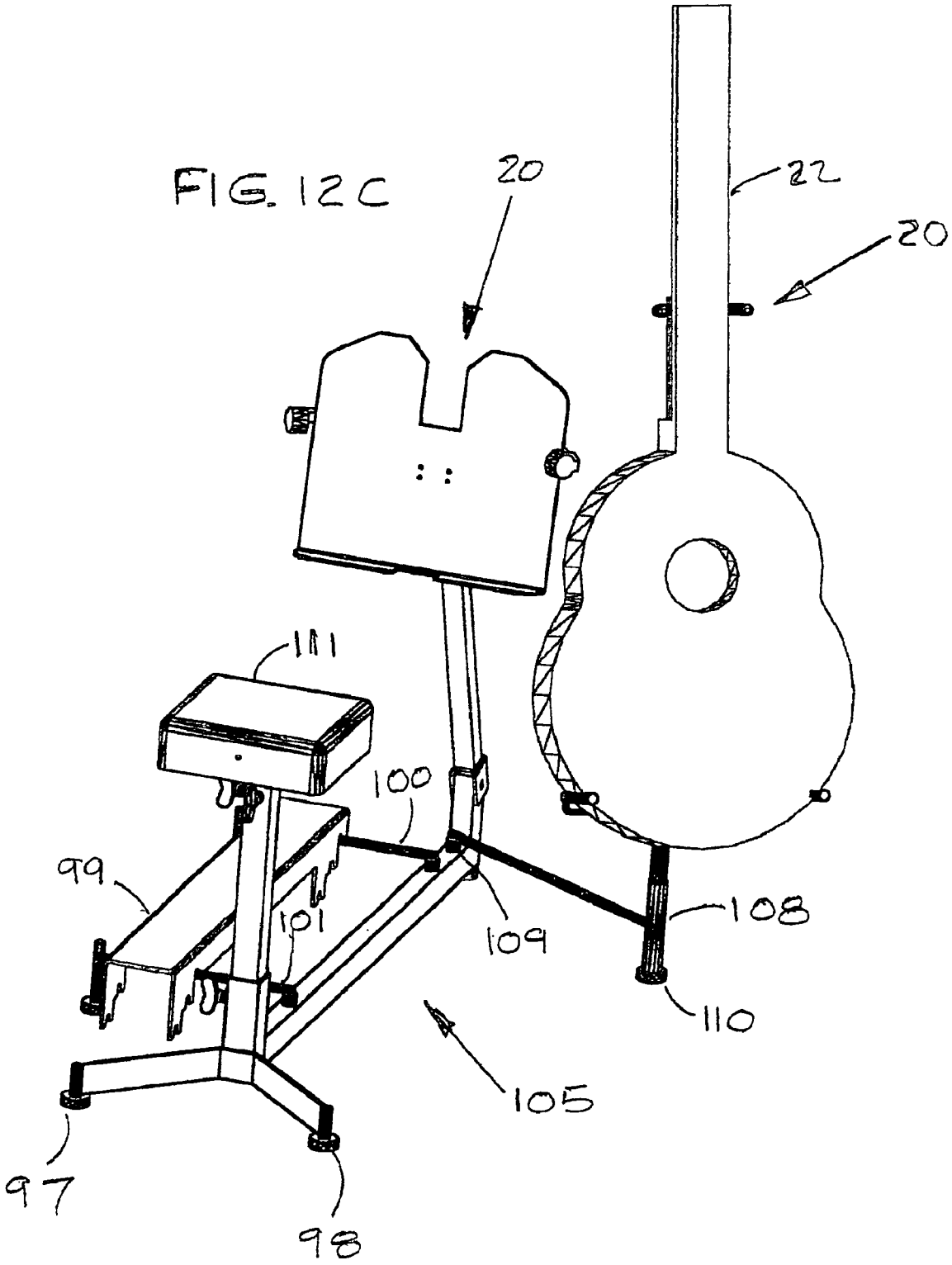
FIG. 12C is right-side rear prospective view of the compact version of the portable utility stand.

FIGS. 12A, 12B, and 12C show a compact version of the portable utility stand. This version, with integrated components easily fits into a guitar case as shown in FIG. 14A. In this version the portable utility stand is supported on three floor guides 96, 97 and 98. Stand stability is achieved by supporting the footrest 99 on forward brace 100 and rear brace 101. Forward brace 100 and rear brace 101 are slidably fitted to guides 102 and 103 in the frame assembly 105. Guide 102 and floor guide 106 support forward brace 100. Guide 103 and floor guide 107 support brace 101. Slidably mounted braces 100 and 101 take the load directly to the floor and prevent utility stand from tipping over should the user stand on the footrest 99. The instrument support subassembly 20 is supported on stalk support brace 108 slidably fitted to guide 109 and supported by floor guide 110. Seat cushion 111 mounted to seat bracket 112 (see FIG. 13) is supported by seat post 113 mounted frame assembly 105 in seat receptacle 114.

Figure 13:
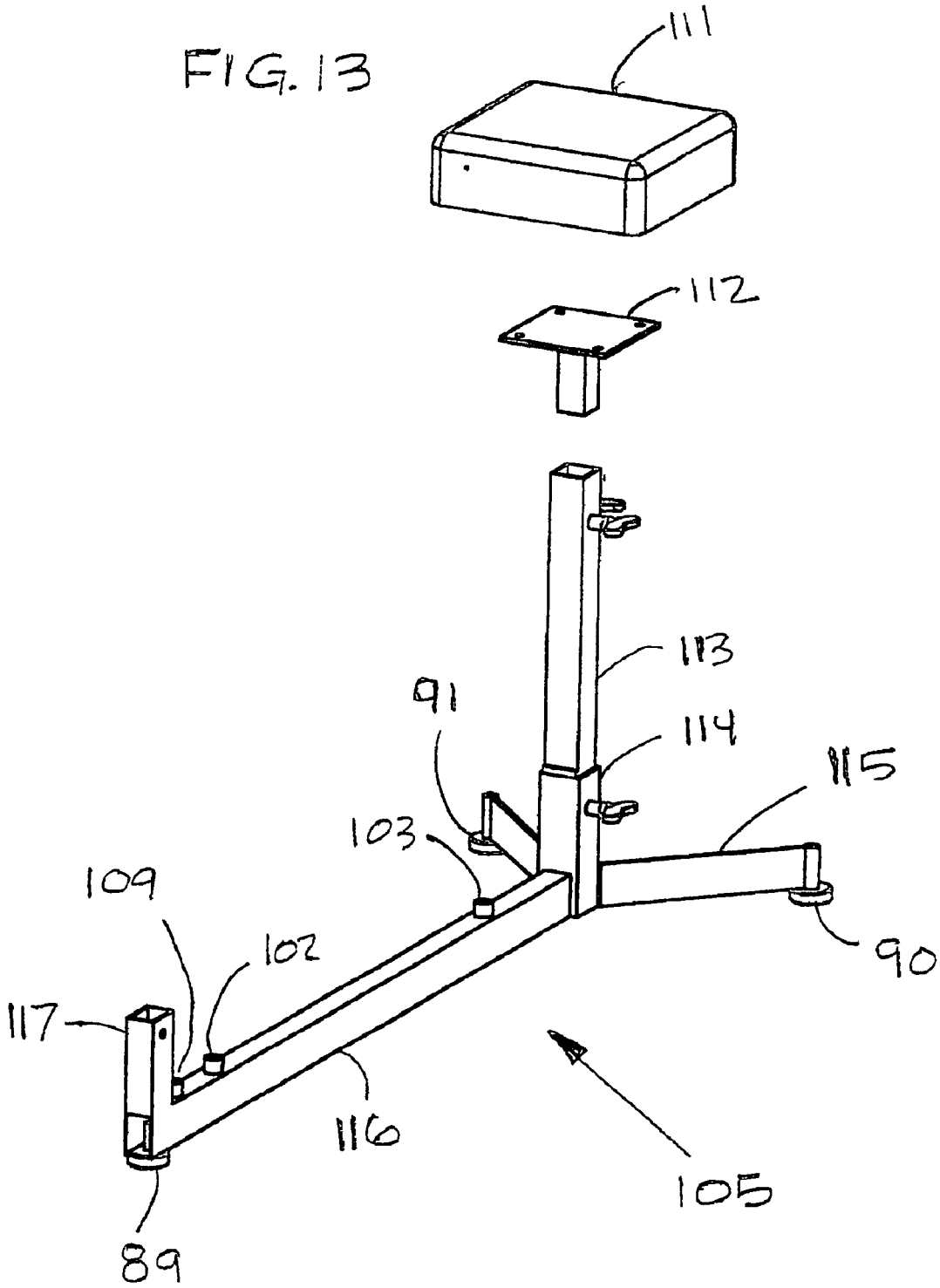
FIG. 13 is a left-side frontal prospective view of the frame configuration for the compact version of the portable utility stand frame.
Figure 14A:
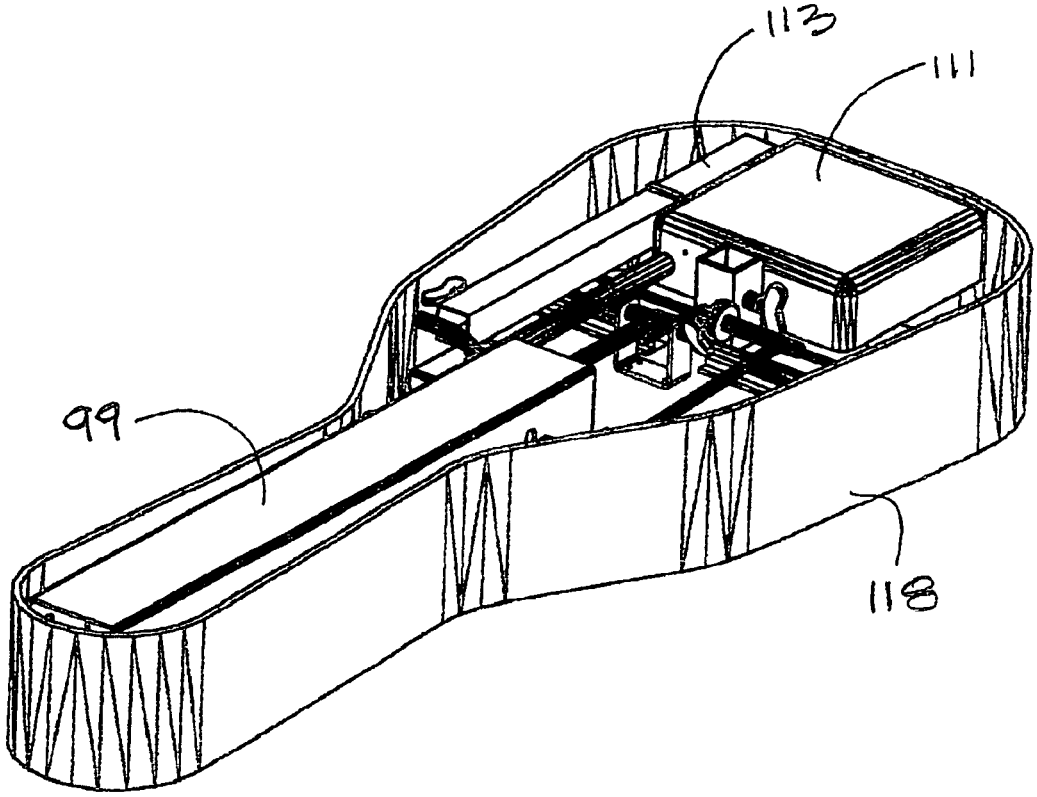
FIG. 14A is left-side frontal prospective view of the compact version of the portable utility stand collapsed inside a standard guitar case.

FIG. 13 shows an exploded view of the seat cushion 111, the seat bracket 112 and the seat post 113 is shown installed in the seat receptacle 114. The rear seat legs 115 are rigidly attached to the seat receptacle 114. Floor guides 90 and 91 are installed in seat legs 115. Beam member 116 is rigidly attached to seat receptacle 114. Guides 103, 102, and 109 provide receptacles for the rear brace 101, forward brace 100 and stalk support brace 108. Post 117 provides for pivotably mounting the instrument support subassembly 20.

FIG. 14A shows the condensed version of the portable utility stand collapsed into guitar case 118.

Figure 14B:
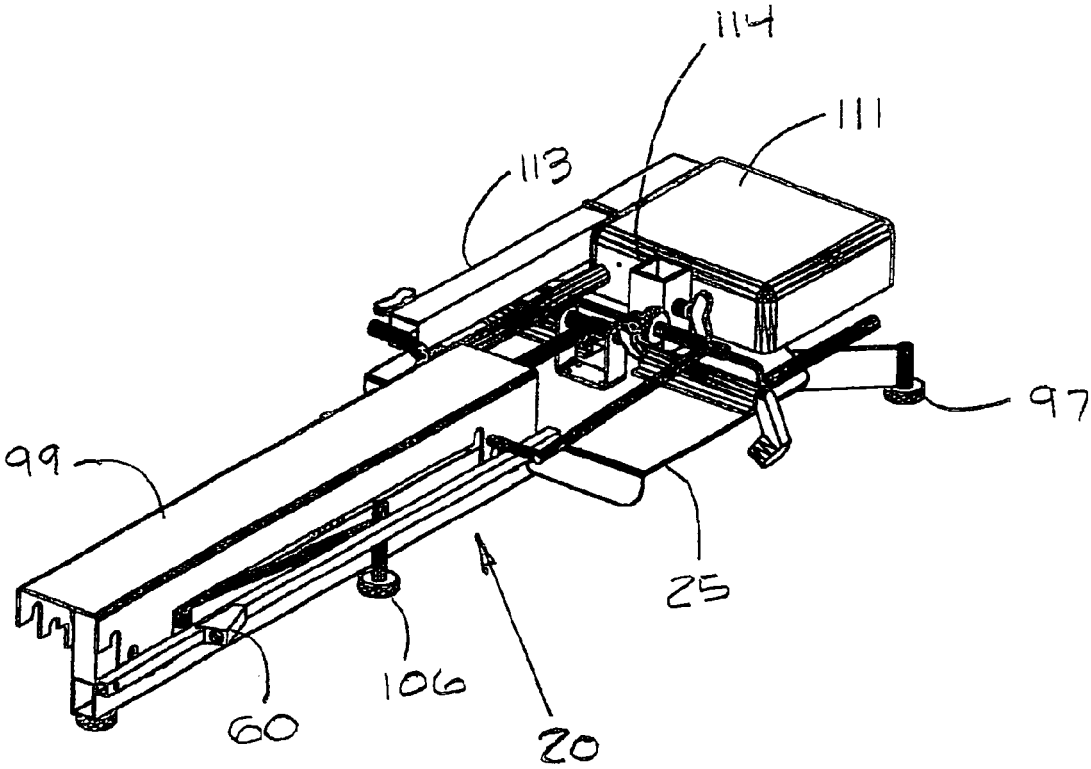
FIG. 14B is left-side frontal prospective view of the compact version of the portable utility stand collapsed with the guitar case removed for clarity.
Figure 14C:
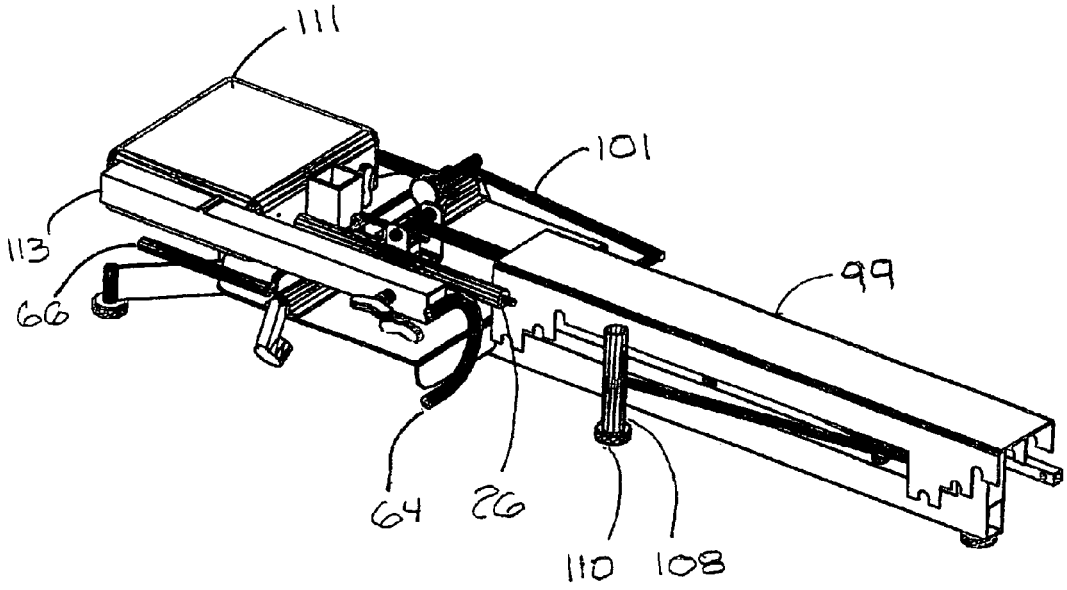
FIG. 14C is right-side frontal prospective view of the compact version of the portable utility stand collapsed with the guitar case removed for clarity.

FIG. 14B shows the condensed version of the portable utility stand with guitar case 118 removed for clarity. The instrument support subassembly 20 is rotated horizontally with the sheet music support 25 notch straddling the seat receptacle 114. Channel shaped footrest 99 straddles the instrument support subassembly 20.

Figure 15A:
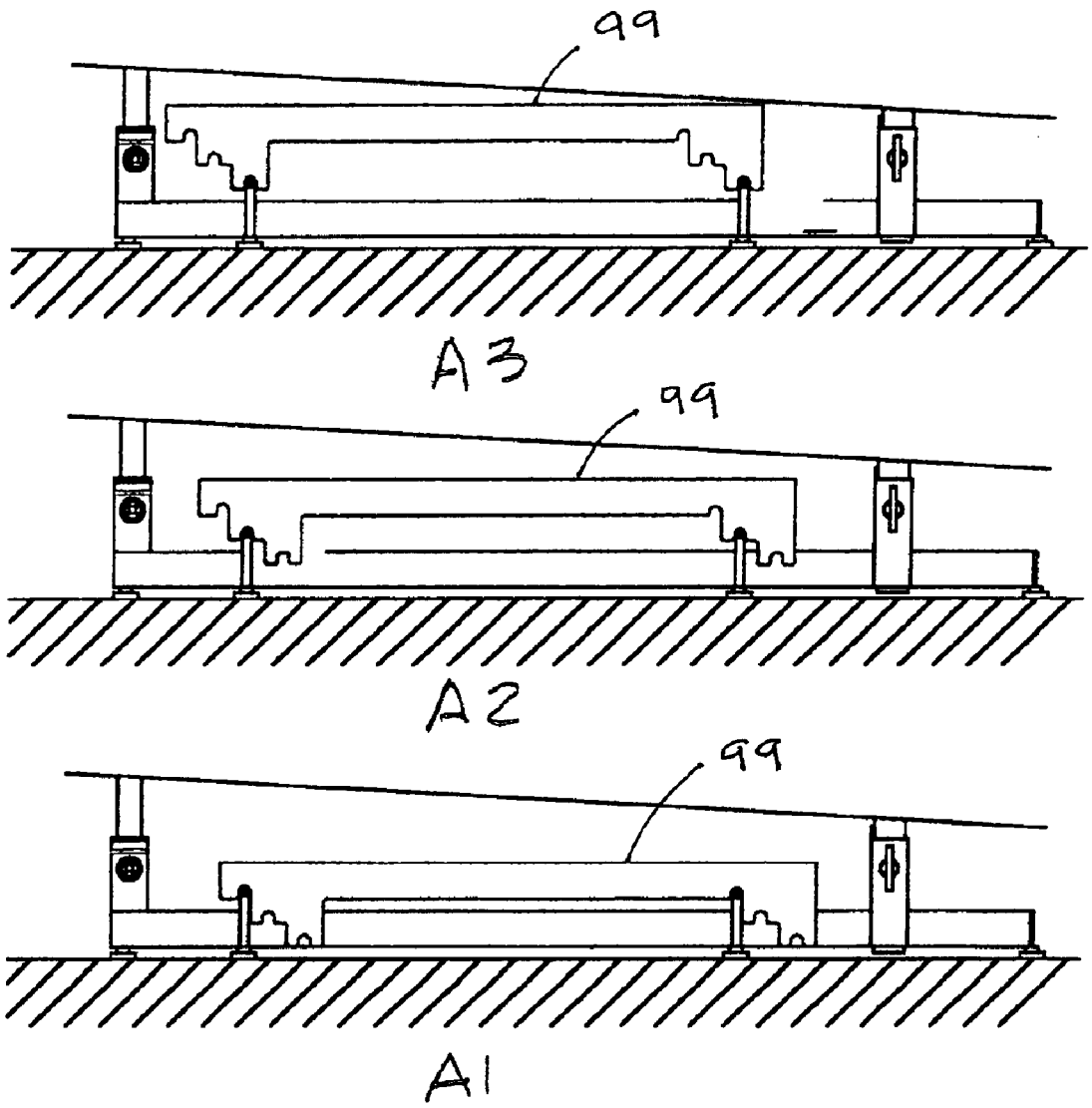
FIG. 15A is a side elevation view of a horizontal version of footrest 99 showing the height adjustment means for the compact portable utility stand.

FIG. 15A shows the footrest 99 for the condensed version of the portable utility stand. Footrest height adjustment is achieved by simply moving footrest 99 forward or backward to a different set of notches that rest on the forward brace 100 and the rear brace 101. A1, A2, and A3 show the height progression for each position.

Figure 15B:
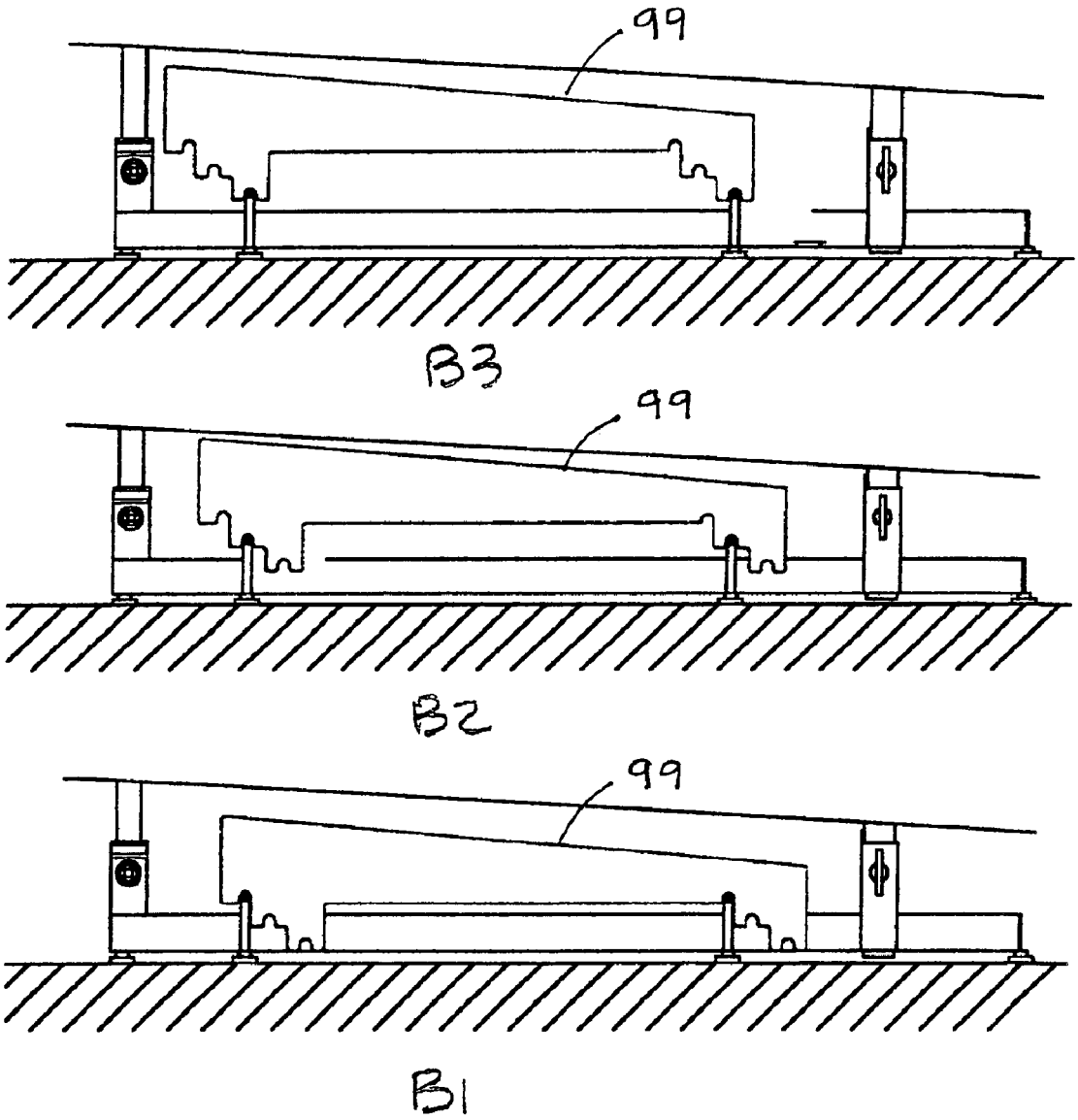
FIG. 15B is a side elevation view of a tilted version of footrest 99 showing the height adjustment means for the compact portable utility stand

FIG. 15 shows the footrest 99 with a tilt for the condensed version of the portable utility stand. Footrest height adjustment is achieved by simply moving footrest 99 forward or backward to a different set of notches that rest on the forward brace 100 and the rear brace 101, B1, B2, and B3 show the height progression for each position.

All of the embodiments disclosed here provide a portable utility stands easily set up for supporting music or other uses, and easily collapsed into a compact configuration for convenient storage or transport. When set up the user has a stable platform to work, practice, or perform. The user has the option of arranging the equipment, as he requires using the universal mounting receptacles. The user tools, and accessories are within easy reach. Expensive instruments or equipment can be rotated to a protected out of the way position between the sheet music support and the seating bench/storage area.

Having described exemplary embodiments of the present invention with reference to the accompanying drawings, it will be appreciated that the present invention is not limited to those precise embodiments, and the various changes and modifications can be effected therein by one of ordinary skill in the art without departing from the scope and spirit of the invention as defined by the appended claims.

What we claim as our invention is:

1. A portable utility stand comprising:

a base frame member with a plurality of user equipment mounting means extending upwardly from the base;

a seat and backrest member wherein the seat member includes a storage compartment comprising a slidably mounted drawer and storage compartment including a means for slidably mounting said seat and backrest to said base frame member;

a slidably and pivotably mounted work/reference platform pivotably mounted to said base frame member;

a pivotably mounted equipment support structure uniquely configured to hold user specific equipment mounted to said base frame member;

a flexible gooseneck equipment support member pivotably mounted to said base frame member;

a plurality of footrest platforms adjustably mounted to said base frame member;

a plurality of reference tables pivotably mounted to said base frame member;

a extension arm member pivotably mounted to said base frame member and pivotably supporting said equipment support structure;

a umbrella whereby the user and his equipment is protected from the elements is mounted to the said base frame using a plurality of the said base frame user equipment mounting means.

2. The portable utility stand of claim 1 wherein:

the portable utility stand is collapsible by removing the equipment from the user equipment mounting means of said base frame member and storing substantially horizontal in close proximity to said base frame member.

3. The portable utility stand of claim 1 wherein:

the equipment mounting means of said base frame are configured to cooperate with all of the mounting stalks of said user equipment providing the user the ability to arrange the equipment on the said base frame to suit personal preference.

4. The portable utility stand of claim 1 wherein:

the said base frame member is composed of three members; a horizontal center member that supports the said seat and footrest equipment mounting means; substantially perpendicular leg members at each end of the said center member supported by mounting feet at the extreme ends of the perpendicular leg members, providing an enlarged bearing surface for supporting said portable utility stand.

5. The portable utility stand of claim 1 wherein:

the seat is slidably adjustable for height and the seat back is pivotably adjusted for tilt.

6. The portable utility stand of claim 1 wherein:

the work/reference platform is illuminated with a plurality of battery powered LED sources mounted to the work/reference platform.

7. The portable utility stand of claim 1 wherein:

a compact version of a portable utility stand comprising a three point supported platform having a means for pivotally collapsing the work surface such that it is stowed below the seat.

8. The portable utility stand of claim 1 wherein:

a footrest support slidably attached to the utility platform providing vertical and lateral stability without affecting the kinematics of a three-point mount.

9. The portable utility stand of claim 1 wherein:

an instrument support slidably attached to the three point supported utility platform providing vertical and lateral stability without affecting the kinematics of a three-point mount.

10. The portable utility stand of claim 1 wherein a collapsible seat assembly is incorporated comprising:

a support member;

a sounding plate;

a cushion.

11. The portable utility stand of claim 1 wherein:

a slidably and pivotably mounted work/reference platform pivotably mounted to said base frame member.

12. The portable utility stand of claim 1 wherein:

a height adjustable footrest support comprised of a series of steps at two displaced points on a member whereby height adjustment is achieved by shifting the beam to a higher or lower set of steps.

* * * * *